US012727699B2

(12) United States Patent
Moss et al.

(10) Patent No.: US 12,727,699 B2
(45) **Date of Patent: *Sep. 8, 2026**

(54) MOUNTING BRACKET

(71) Applicant: House of Atlas, LLC, Evanston, IL (US)

(72) Inventors: Jason Moss, Libertyville, IL (US); Matthew Berman, Chicago, IL (US)

(73) Assignee: House of Atlas, LLC, Evanston, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/740,110

(22) Filed: Jun. 11, 2024

(65) Prior Publication Data

US 2024/0407583 A1 Dec. 12, 2024

Related U.S. Application Data

(63) Continuation of application No. 17/964,736, filed on Oct. 12, 2022, now Pat. No. 12,207,751.

(51) Int. Cl.
*A47H 1/142* (2006.01)

(52) U.S. Cl.
CPC ..... *A47H 1/142* (2013.01)

(58) Field of Classification Search
CPC ..... A47H 1/142; A47H 1/102; A47H 1/10; A47H 1/12; A47H 1/104; A47H 1/122; A47H 1/124; A47H 1/14; A47H 1/144; A47H 1/02; A47H 2001/021; A47G 25/0607; A47G 25/0635; A47K 2201/00; A47K 2201/02; A47K 2201/025; A47B 96/068; F16B 15/0053
See application file for complete search history.

(56) References Cited

U.S. PATENT DOCUMENTS 3,131,251 A * 4/1964 Ryan ..... B60R 1/04 248/467
3,252,178 A 5/1966 Check
4,708,552 A 11/1987 Bustos
4,795,294 A * 1/1989 Takada ..... A47G 1/22 248/547

(Continued)

FOREIGN PATENT DOCUMENTS

CA 2722843 1/2012

*Primary Examiner* — Kimberly T Wood
(74) *Attorney, Agent, or Firm* — Fitch, Even, Tabin & Flannery LLP

(57) ABSTRACT

A mounting bracket is provided for attachment to a mounting surface. The mounting bracket has a body having a first surface and an opposite second surface and a first end and a second end. The second surface is profiled to engage a mounting surface. The body defines a first mounting hole extending obliquely through the body relative to the second surface from the first surface to the second surface, the first mounting hole extending in part toward the second end as the first mounting hole extends from the first surface toward the second surface. The body defines a second mounting hole extending obliquely through the body relative to the second surface from the first surface to the second surface, the second mounting hole extending in part toward the first end as the first mounting hole extends from the first surface toward the second surface.

17 Claims, 22 Drawing Sheets

(56) References Cited

U.S. PATENT DOCUMENTS

| | | | | |
|---|---|---|---|---|
| 5,346,169 | A * | 9/1994 | Polonsky | A47G 1/20 248/225.11 |
| 5,425,524 | A | 6/1995 | Messina, Jr. | |
| 5,433,413 | A | 7/1995 | Adams | |
| 5,433,416 | A | 7/1995 | Johnson | |
| 5,687,942 | A | 11/1997 | Johnson | |
| 8,757,570 | B2 | 6/2014 | Ernst | |
| 8,899,541 | B2 | 12/2014 | Bixler | |
| 10,070,740 | B2 * | 9/2018 | Jacobs | F16M 13/02 |
| 10,648,492 | B2 | 5/2020 | Hanley | |
| 10,724,678 | B1 | 7/2020 | Elliott | |
| 10,842,299 | B2 * | 11/2020 | Dempsey | A47B 96/068 |
| 11,002,302 | B2 | 5/2021 | Hanley | |
| 11,092,176 | B2 | 8/2021 | Hanley | |
| 11,111,942 | B2 | 9/2021 | Cogburn | |
| 11,181,225 | B2 * | 11/2021 | Kawaguchi | F16M 11/041 |
| 12,016,482 | B2 * | 6/2024 | Moss | A47H 1/142 |
| 12,207,751 | B2 * | 1/2025 | Moss | A47H 1/142 |
| 2005/0006554 | A1 | 1/2005 | Deline | |
| 2007/0186384 | A1 | 8/2007 | Broehl | |
| 2010/0219308 | A1 * | 9/2010 | Ernst | F16B 45/005 248/217.4 |
| 2012/0024809 | A1 * | 2/2012 | Rowan | A47H 13/00 211/124 |
| 2019/0282017 | A1 | 9/2019 | Hanley | |
| 2020/0200156 | A1 | 6/2020 | Dall'Asta | |
| 2020/0325925 | A1 | 10/2020 | Cogburn | |
| 2021/0062966 | A1 * | 3/2021 | Woolman | A47H 1/104 |
| 2021/0364027 | A1 | 11/2021 | Cogburn | |
| 2024/0122390 | A1 | 4/2024 | Moss | |
| 2024/0306835 | A1 | 9/2024 | Moss | |

* cited by examiner

MOUNTING BRACKET

CROSS-REFERENCE TO RELATED APPLICATION

This application is a continuation of U.S. application Ser. No. 17/964,736, filed Oct. 12, 2022, which is hereby incorporated herein by reference in its entirety.

FIELD

This disclosure relates to mounting brackets and, in particular, to mounting brackets for wall mounted items.

BACKGROUND

Many homes include wall mounted hardware, for example, curtain rod systems. Installation of curtain rod systems can be difficult and cumbersome, particularly for homeowners attempting to mount such curtain rod systems. For example, for many curtain rod systems, to securely mount the curtain rod system to a wall requires the installer to follow several steps and may require the use of several different types of tools or fasteners. Homeowner's installing such wall mounted hardware desire hardware that can be easily installed and that remains firmly secured to the wall during use.

DETAILED DESCRIPTION

Figure 1:
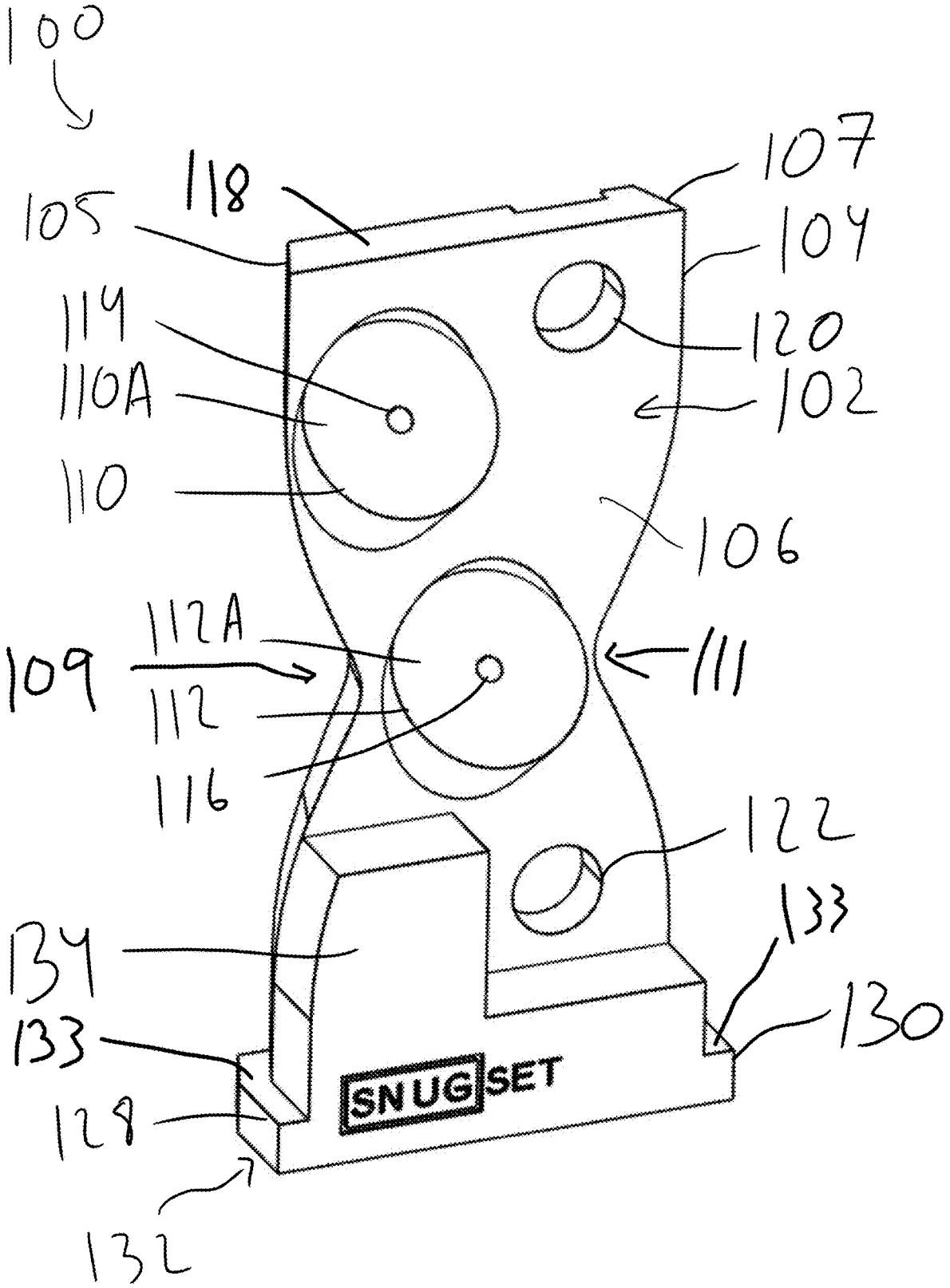
FIG. 1 is a front perspective view of a mounting bracket according to one embodiment.
Figure 2:
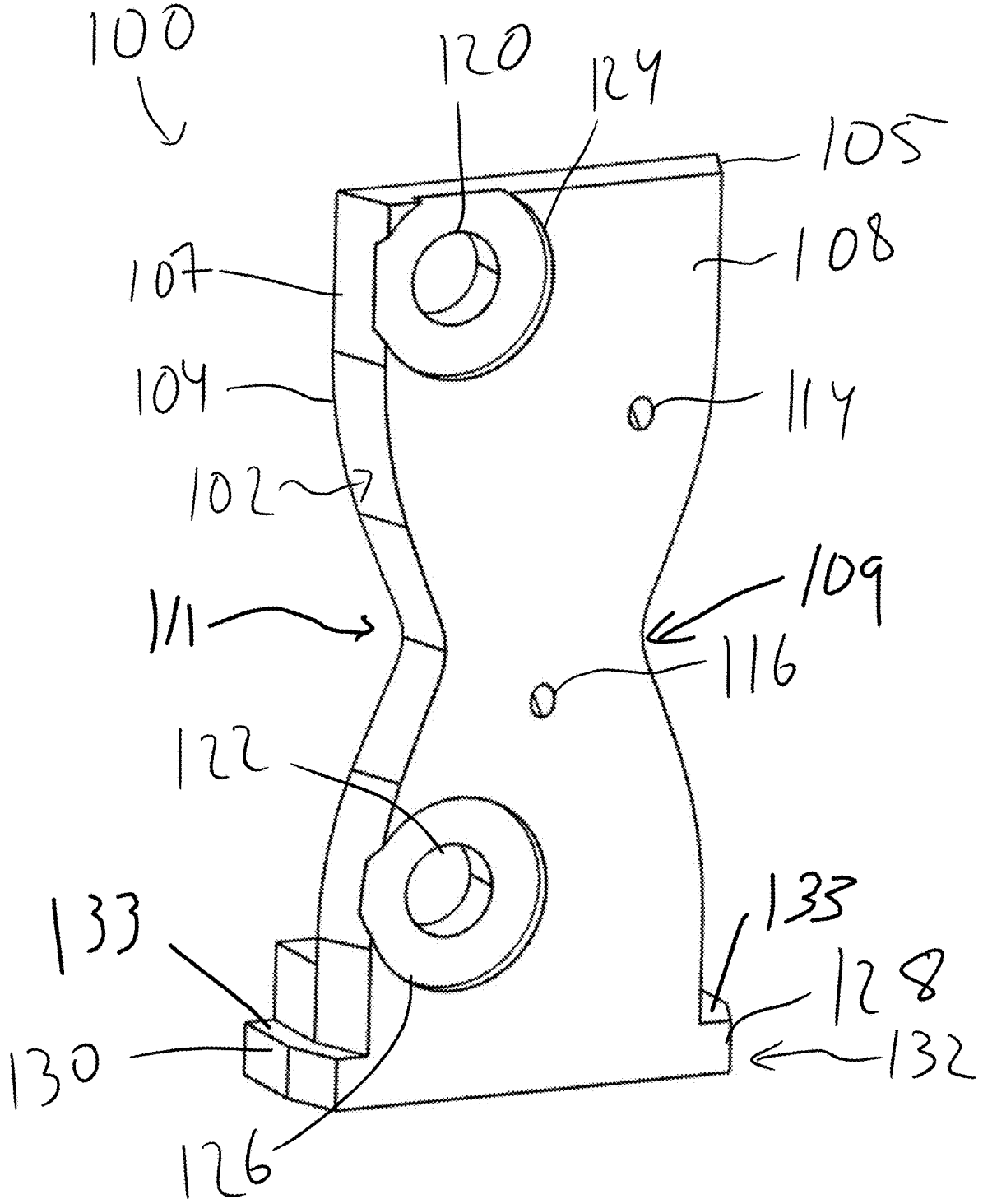
FIG. 2 is a rear perspective view of the mounting bracket of FIG. 1.

With respect to FIGS. 1-6, a mounting bracket 100 is provided for attaching hardware to a support structure, such as a wall or door. The mounting bracket 100 includes a body 102 having a plate portion 104 with a front surface 106 and a rear surface 108. The body 102 may be formed of a plastic material such as, for example, polycarbonate (PC), acrylonitrile butadiene styrene (ABS), zinc, aluminum, nylon, and polyoxymethylene. The body 102 may be a molded body, for example, formed by an injection molding process, a stamped body, or a machined body.

In some forms, the body 102 is a single piece component. In other forms, the body 102 is formed from two or more pieces assembled to one another. The plate portion 104 has side edges 105, 107 that taper inward from the front surface 106 to the rear surface 108 such that the width of the plate portion 104 at the front surface 106 is greater than at the rear surface 108. For example, the side edges 105, 107 of the plate portion 104 angle outwardly as the side edges 105, 107 extend from the rear surface 108 toward the front surface 106. This tapered configuration forms an inner rail or track that is used for securing hardware to the mounting bracket 100 as described in further detail below.

The plate portion 104 of the body 102 may have a generally hourglass shape having recessed portions 109, 111 formed along the side edges 105, 107. Including the recessed portions 109, 111 may reduce the amount of material used to form the body 102. The recessed portions 109, 111 may also receive a mating structure of the hardware component attached to the body 102 to inhibit the hardware component from moving relative to the body 102. For example, the hardware component may have inwardly extending protrusions that extend into the recessed portions 109, 111 and inhibit the hardware component from sliding vertically along the side edges 105, 107.

Figure 5:
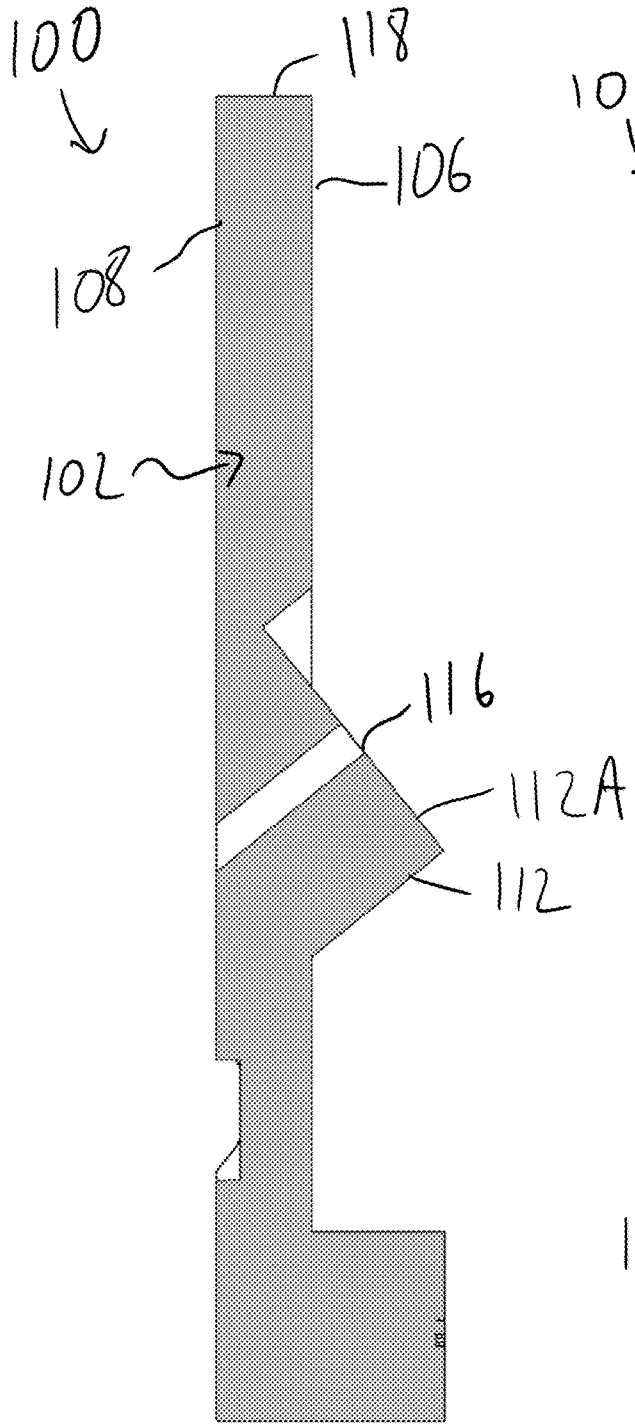
FIG. 5 is a cross-sectional view of the mounting bracket of FIG. 1 taken along line 5-5 of FIG. 4.
Figure 6:
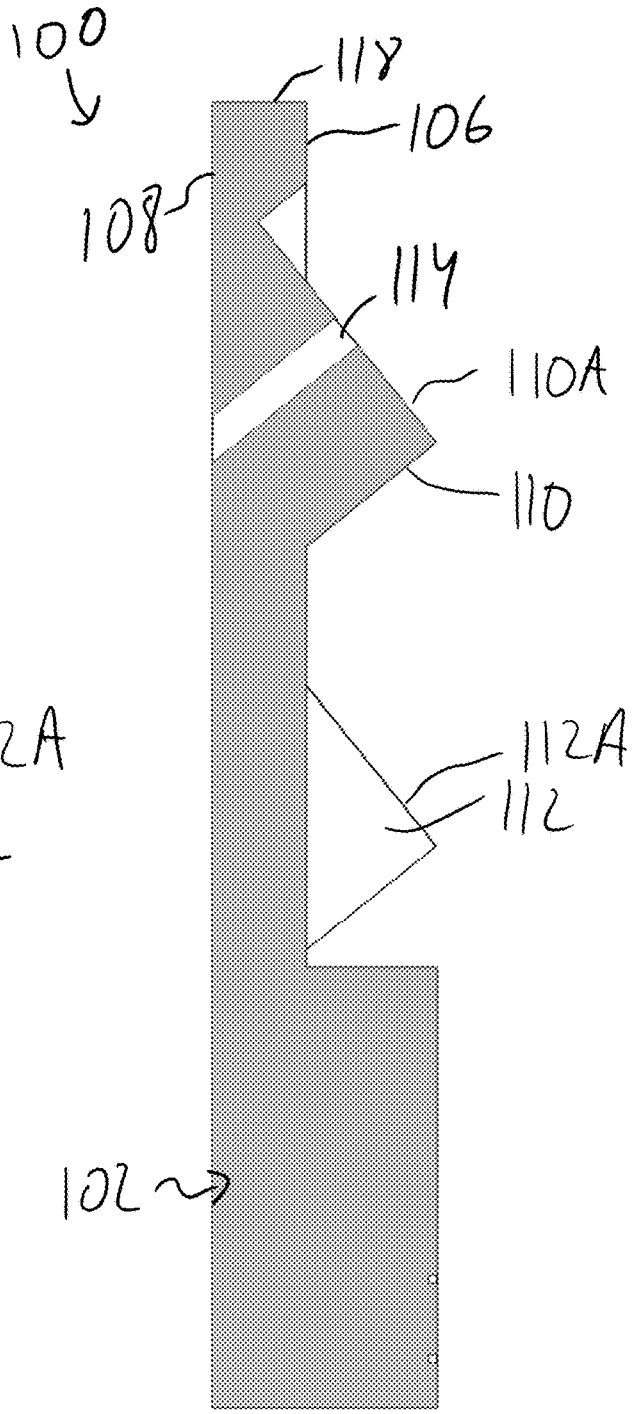
FIG. 6 is a cross-sectional view of the mounting bracket of FIG. 1 taken along line 6-6 of FIGS. 4.

The mounting bracket 100 includes protrusions 110, 112 extending obliquely from the front surface 106 of the body 102. The protrusions 110, 112 may have a substantially cylindrical shape. The protrusions 110, 112 terminate at end faces 110A, 112A and include passages 114, 116 extending through the protrusions 110, 112 and through the rear surface 108 of the body 102. As shown in FIGS. 5-6, the passages 114, 116 may extend obliquely to the front surface 106 and/or rear surface 108 of the body 102. The passages 114, 116 may extend at an angle of approximately 40-60 degrees relative to the rear surface 108. As one example the passages 114, 116 may extend at approximately a 50 degree angle relative to the rear surface 108. Alternatively, the passages 114, 116 may extend at different angles relative to the rear surface 108. The passages 114, 116 are sized to receive fasteners, including, for example, nails or screws, therethrough for securing the mounting bracket 100 to a mounting surface such as a wall or a door. The orientation of the passages 114, 116 guides or directs the fasteners as they are extended through the passages 114, 116 from the front surface 106 to the rear surface 108 and into the mounting surface such that the fasteners extend into the mounting surface at an angle. Extending the nails into the mounting surface at a downward angle (e.g., 50 degrees) increases the amount of weight the mounting bracket 100 can bear once mounted to the mounting surface. The first protrusion 110 extends from an upper portion of the body 102, and the second protrusion 112 extends from a middle portion of the body 102 lower than the first protrusion 110. More specifically, the first protrusion 110 may be located closer to a top surface 118 than the second protrusion 112 and may be off center of a longitudinal axis of the body 102. The second protrusion also may be in the region of a necked portion of the hourglass shape of the body 102. Locating at least the first protrusion 110 and the passage 114 at an upper portion of the mounting bracket 100 enables the mounting bracket 100 to support relatively heavier loads.

The body 102 of the mounting bracket 100 may further include mounting holes 120, 122 that may also be used for mounting the mounting bracket 100 to a mounting surface. The mounting holes 120, 122 may be used to mount the mounting bracket 100 to a mounting surface as an alternative mounting method or in addition to use of the passages 114, 116 of the protrusions 110, 112 for increased mounting strength. The mounting holes 120, 122 extend from the front surface 106 and through the rear surface 108. Fasteners may be extended through the holes 120, 122 and into the mounting surface to secure mounting bracket 100 to the mounting surface. As an example, where the mounting surface is drywall, wall anchors may be inserted into the drywall and screws may be extended through the mounting holes 120, 122 and into the wall anchors to attach the mounting bracket 100 to the wall. The rear surface 108 of the body 102 may have annular recesses 124, 126 about the mounting holes 120, 122. The recesses 124, 126 provide space to receive a portion of a wall anchor extending from the wall (e.g., a flange of the wall anchor) such that the rear surface 108 of the body 102 lays flat against the mounting surface. The first mounting hole 120 may be at an upper portion of the body 102, and the second mounting hole 122 may be at the lower or middle portion of the body 102 below the first mounting hole 120. Further, the mounting holes 120, 122 may be off center of the longitudinal axis of the body 102 and may be aligned with one another along the body 102. Including at least the first mounting hole 120 at an upper portion of the mounting bracket 100 enables the mounting bracket 100 to support relatively heavier loads.

Figure 3:
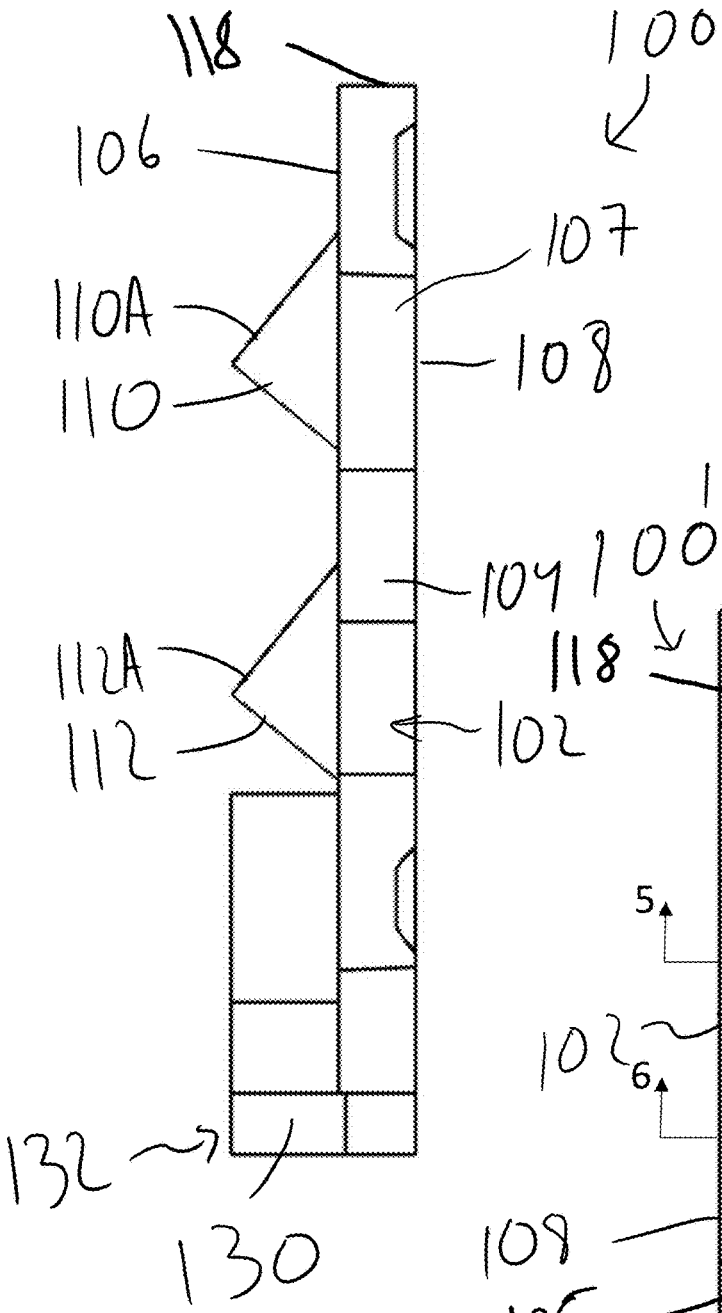
FIG. 3 is a right-side elevation view of the mounting bracket of FIG. 1.
Figure 4:
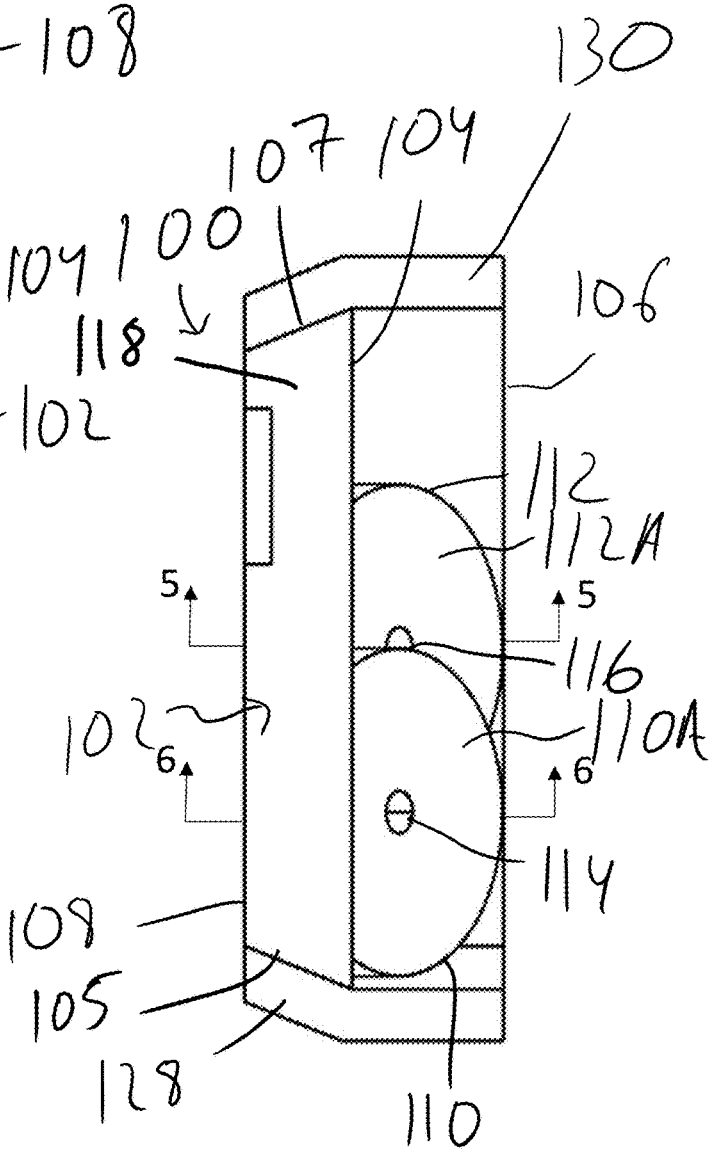
FIG. 4 is a top plan view of the mounting bracket of FIG. 1.

The body 102 of the mounting bracket 100 includes support flanges 128, 130 that extend outward from the sides of the body 102. The support flanges 128, 130 form a base 132 of the mounting bracket 100 with a greater width than the plate portion 104 extending upward from the base 132. The support flanges 128, 130 of the base 132 form a stop or support ledge 133 that hardware attached to the mounting bracket 100 contacts to support the hardware as described in further detail below. The lower portion of the body 102 has a support surface 134 that contacts hardware attached to the mounting bracket 100. The support surface 134 engages the hardware to aid in keeping the hardware aligned with the mounting bracket 100 as described in further detail below. The support surface 134 may have a thickness that is the thickest portion of the body 102. As shown in FIG. 3, the thickest portion of the protrusions 110, 112 have a thickness that is approximately equal to the thickness of the body 102 at the support surface 134.

By way of example, the body 102 may have a length of approximately 1.75 inches, a width of approximately 0.91 inches, and a thickness at the support surface 134 of 0.3 inches. The side edges 105, 107 may have a width at the front surface 106 of approximately 0.91 inches and a width of approximately 0.79 inches at the rear surface 108. The support flanges 128, 130 may have a height of approximately 0.1 inches.

To attach the mounting bracket 100 to a mounting surface, the rear surface 108 of the mounting bracket may be held in contact with the mounting surface at the desired mounting location. A first nail may be extended into the hole 116 and driven into the mounting surface, for example, by hammering the nail into the mounting surface with a hammer. A second nail may be extended into the hole 114. The mounting bracket 100 may be pivoted about the first nail until the mounting bracket 100 to the desired orientation, for example, with a top surface 118 and/or the base 132 of the body 102 being level. Once the mounting bracket 100 is in the desired orientation, the second nail may be driven into the mounting surface.

With respect to FIGS. 7-10, a rod support arm 200 is shown that may be removably attached to the mounting bracket 100 to mount the rod support arm 200 to a mounting surface. The rod support arm 200 includes an attachment leg 202 extending substantially vertically to an arm 204 that extends substantially horizontally to a cradle 206. The cradle 206 has an arcuate shaped surface that is sized to receive and support a rod (e.g., a curtain rod or towel rod). The cradle 206 includes a threaded hole 208 and a screw 210. The screw 210 may be rotated to extend the screw 210 into the cradle 206 to secure the rod within the cradle 206 to inhibit the rod from being unintentionally removed from the cradle 206 and/or from unintentional lateral movement of the rod within the cradle 206. The screw 210 may be rotated in the opposite direction to withdraw the screw 210 from the cradle 206 to permit the rod to be inserted into or removed from the cradle 206.

Figure 9:
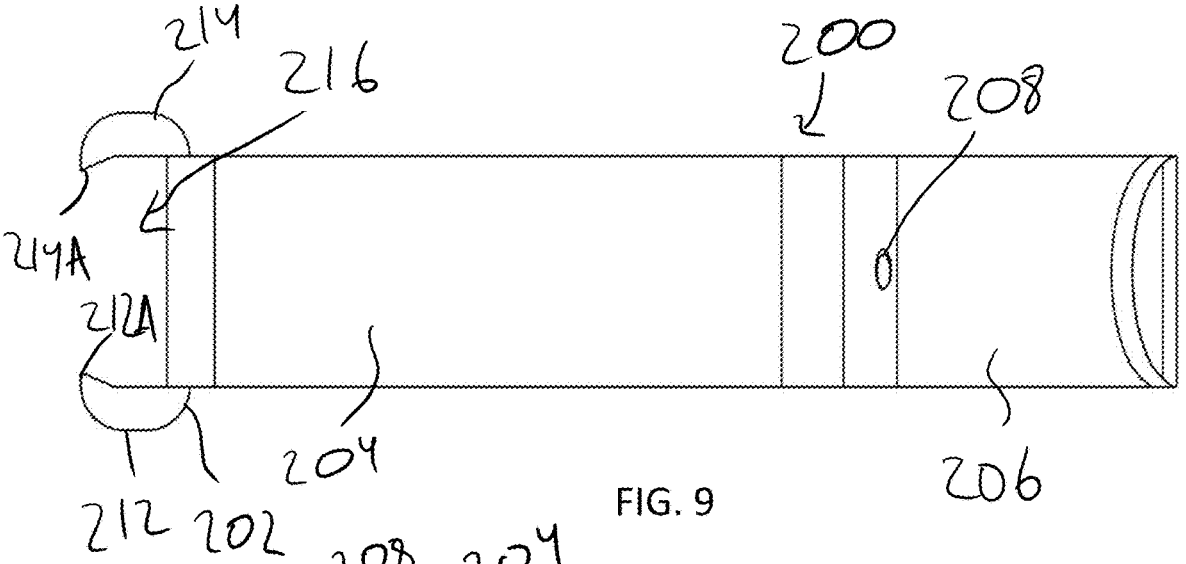
FIG. 9 is a top plan view of the rod support arm of FIG. 7.

With respect to FIG. 9, the attachment leg 202 includes sidewalls 212, 214 that extend rearwardly from the attachment leg 202. The sidewalls 212, 214 each include end portions or opposing protrusions 212A, 214A that angle or toe inward to hook the tapered side edges 105, 107 of the plate portion 104 of the mounting bracket 100. The sidewalls 212, 214 thus form an elongated slot 216 to receive at least the plate portion 104 of the mounting bracket 100 that the attachment leg 202 is able to slide along.

The attachment leg 202 contacts the support surface 134 of the lower portion of the body 102. The support surface 134 engages the attachment leg 202 to inhibit the rod support arm 200 from pivoting relative to the mounting bracket 100. For example, a load on arm 204 of the rod support arm 200 may apply a force to leg 202 so that leg 202 wants to pull away from the mounting bracket. The engagement between the leg 202 and support surface 134 counters this force. The size of the surface 134 is preferably large enough relative to the overall size of the mounting bracket 100 to absorb the load on the arm 204.

Figure 7:
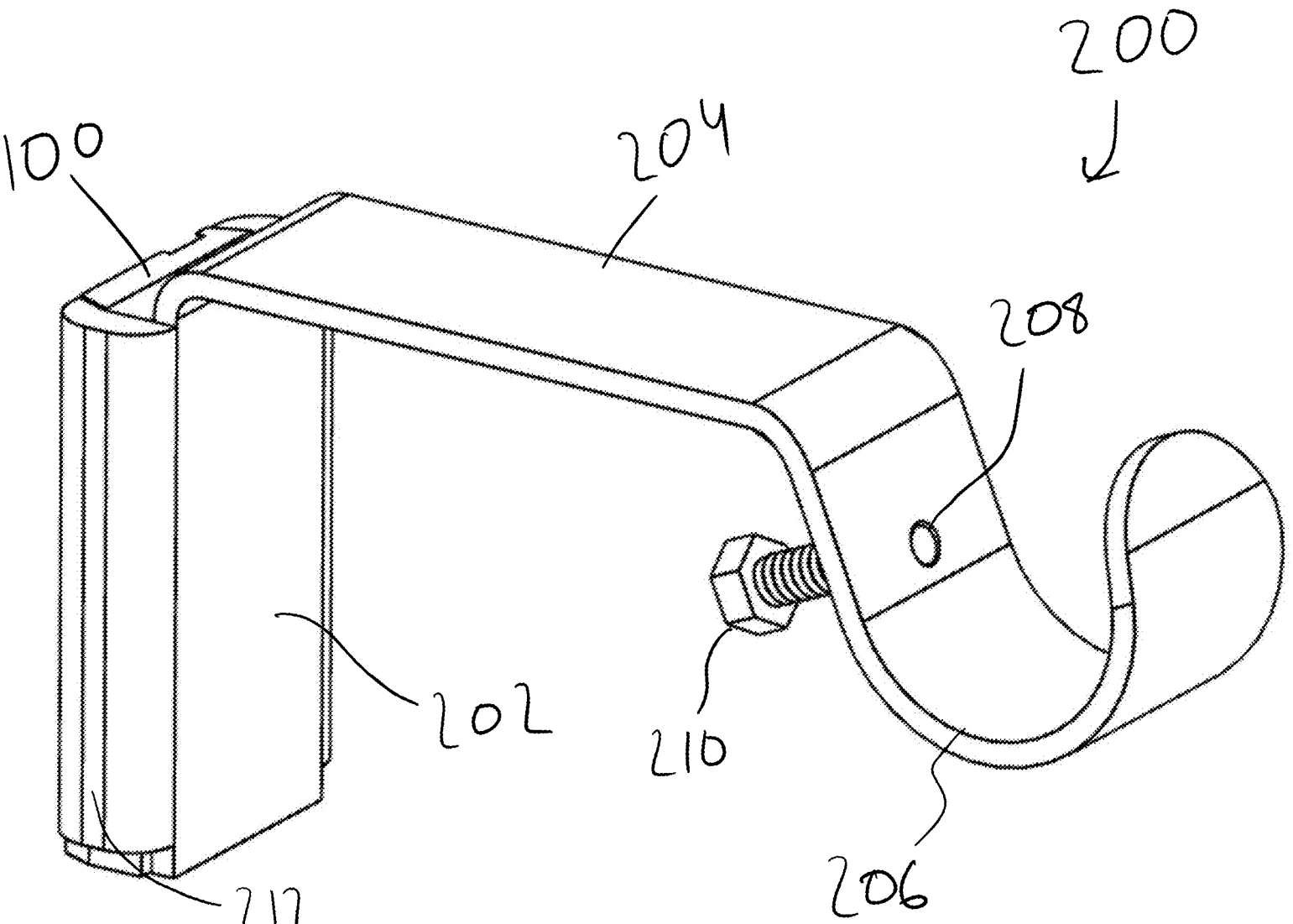
FIG. 7 is a top perspective view of a rod support arm attached to the mounting bracket of FIG. 1.
Figure 8:
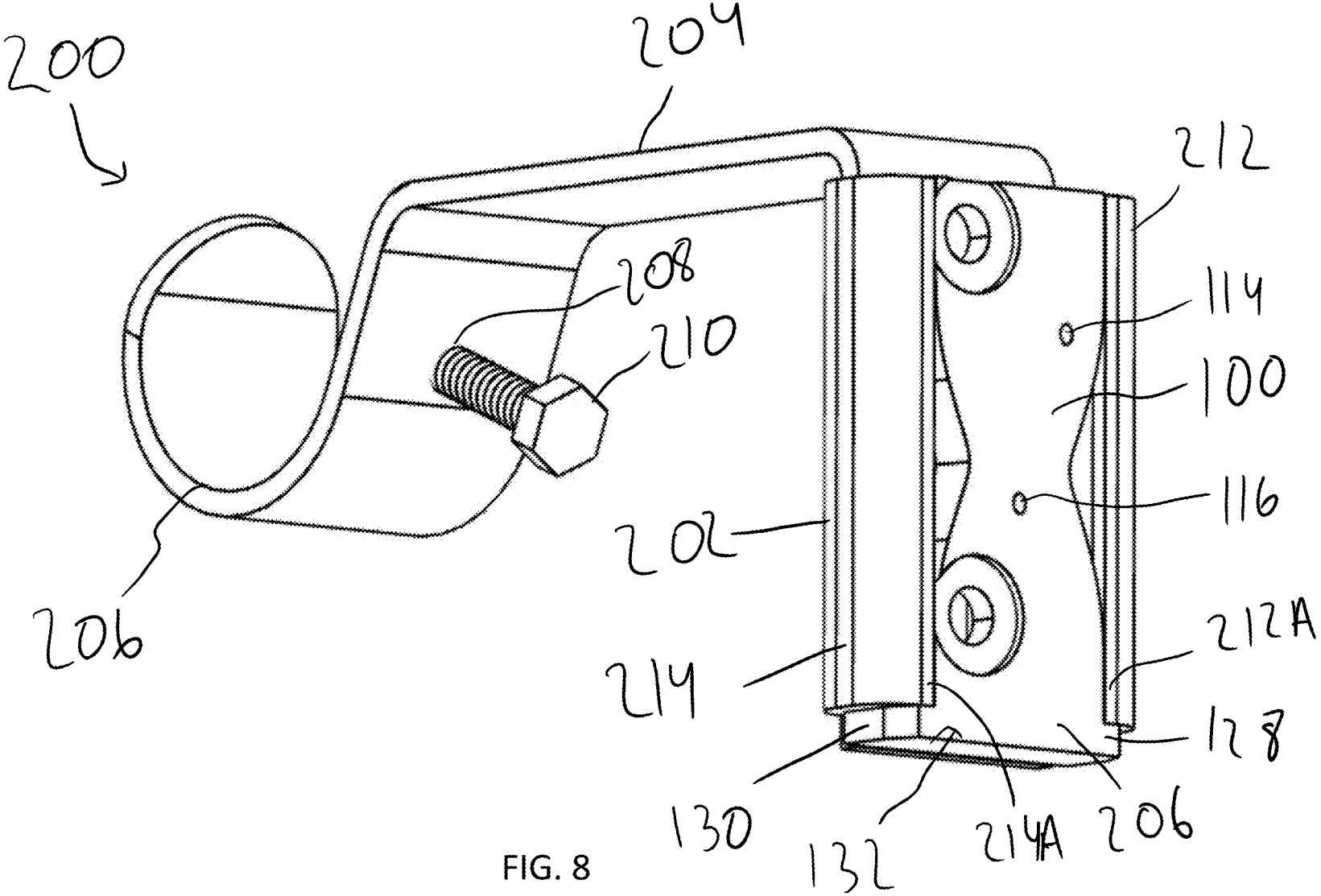
FIG. 8 is a rear perspective view of the rod support arm of FIG. 7 attached to the mounting bracket of FIG. 1.
Figure 10:
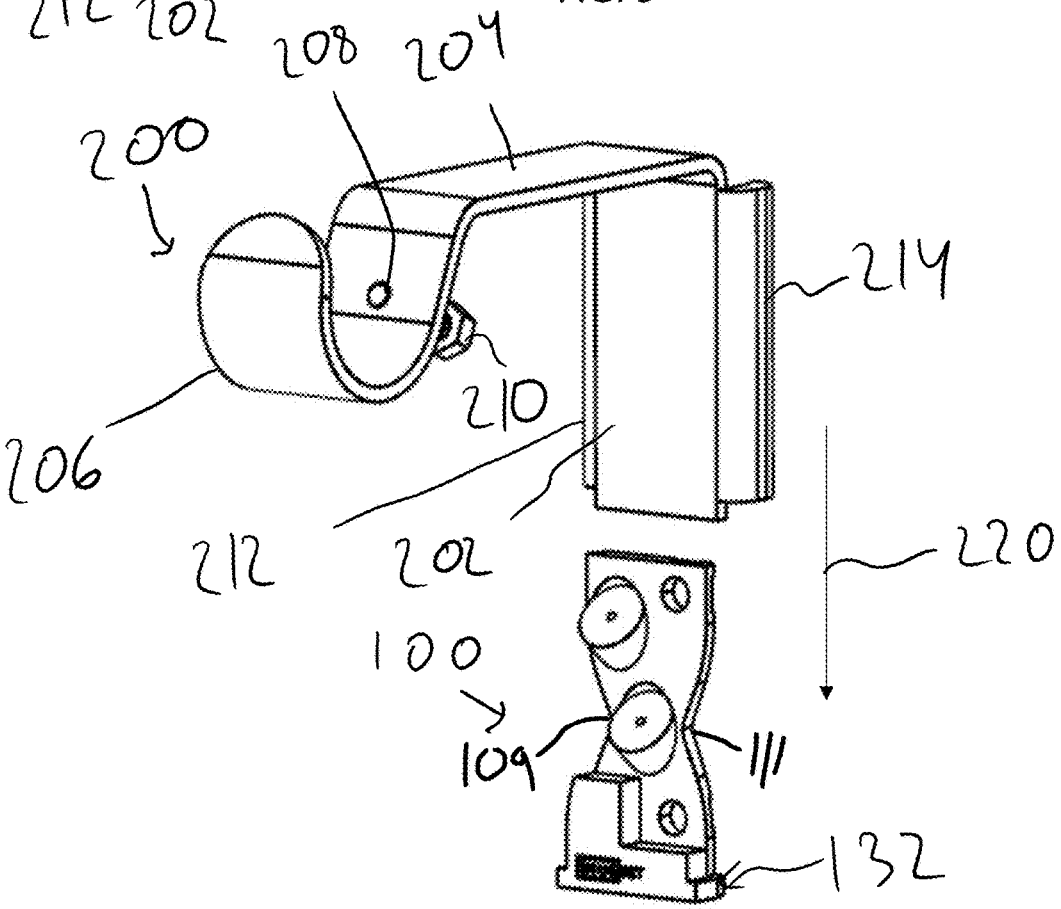
FIG. 10 is a perspective view illustrating attachment of the rod support arm of FIG. 7 to the mounting bracket of FIG. 1.

With respect to FIG. 10, to attach the rod support arm 200 to the mounting bracket 100, the lower end of the attachment leg 202 may be aligned with the upper end of the plate portion 104 of the mounting bracket 100 to align the elongated slot 216 with the body 102 of the mounting bracket. The rod support arm 200 may slide downward on the body 102 in direction 220 with the sidewalls 212, 214 wrapping partially about the plate portion 104 of the mounting bracket 100 until the lower end of the attachment leg 202 abuts the base 132 (as shown in FIGS. 7-8). The sidewalls 212, 214 engage the tapered side edges 105, 107 of the body 102. The sidewalls 212, 214 may extend near the rear surface 108 of the body 102 so that the sidewalls 212, 214 extend near the wall and conceal the mounting bracket 102.

Figure 11:
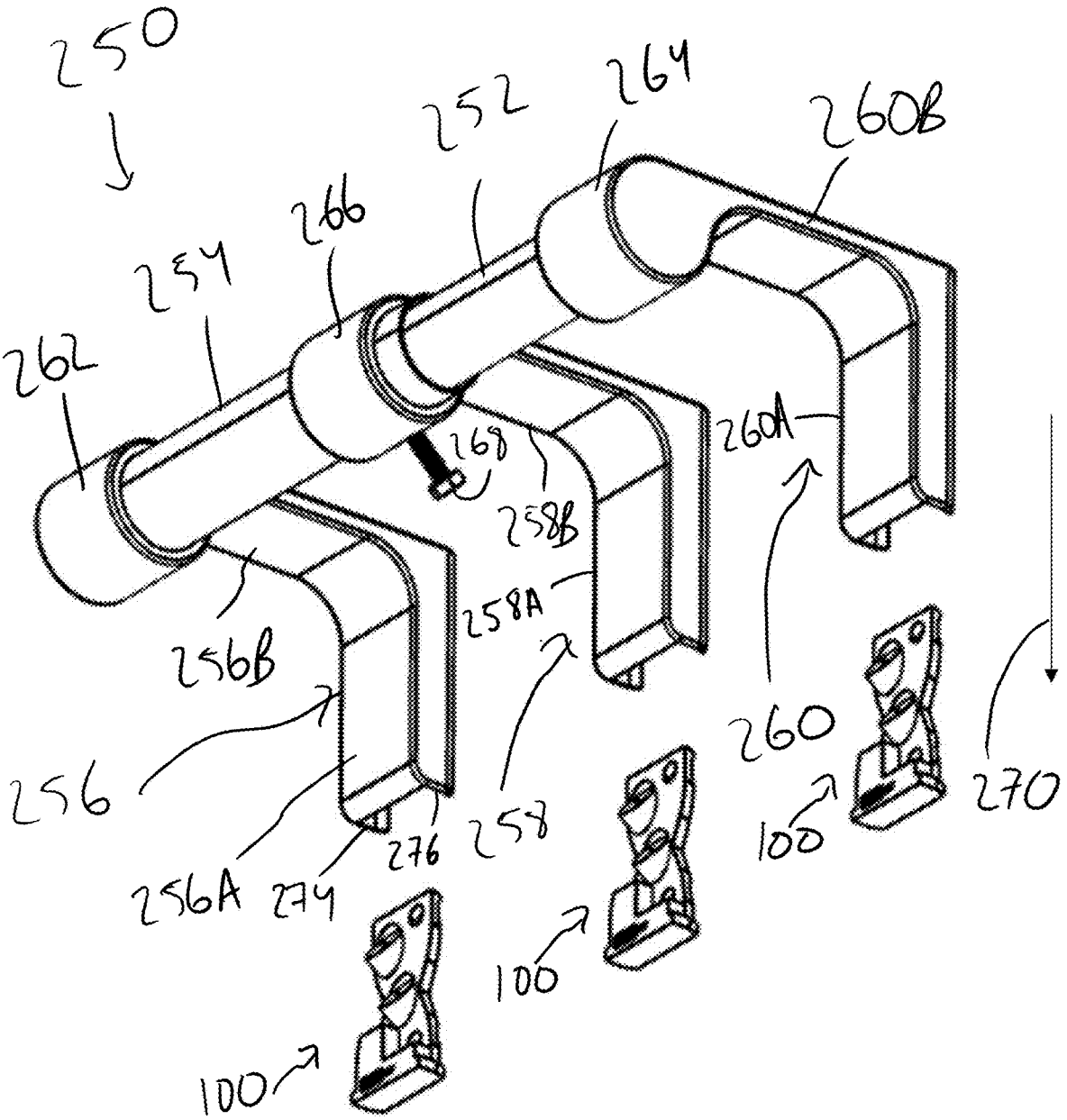
FIG. 11 is a bottom perspective view of a rod system configured to be mounted to the wall with the mounting brackets of FIG. 1.
Figure 12:
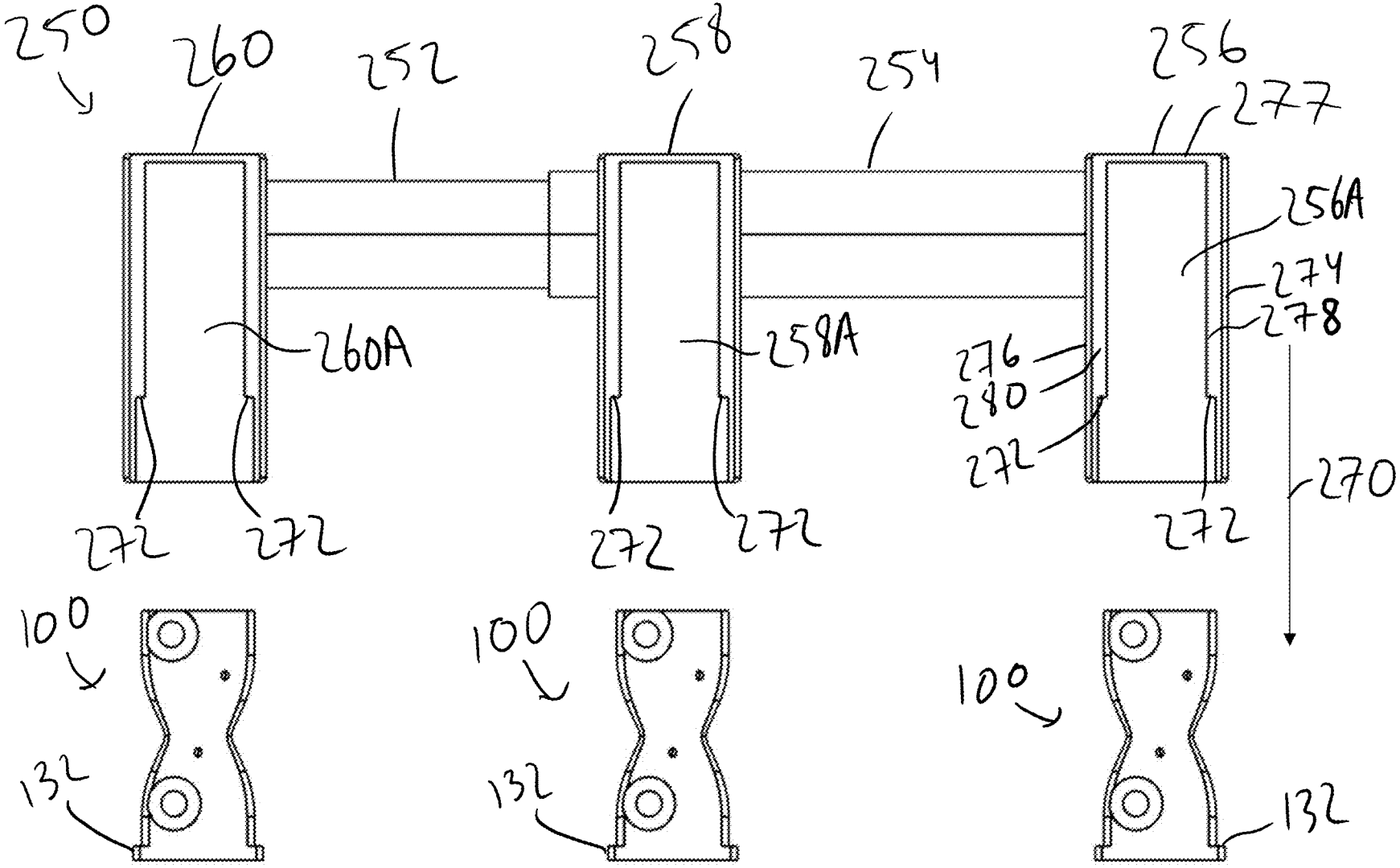
FIG. 12 is a rear elevation view of the rod system of FIG. 11 separated from the mounting brackets.
Figure 13:
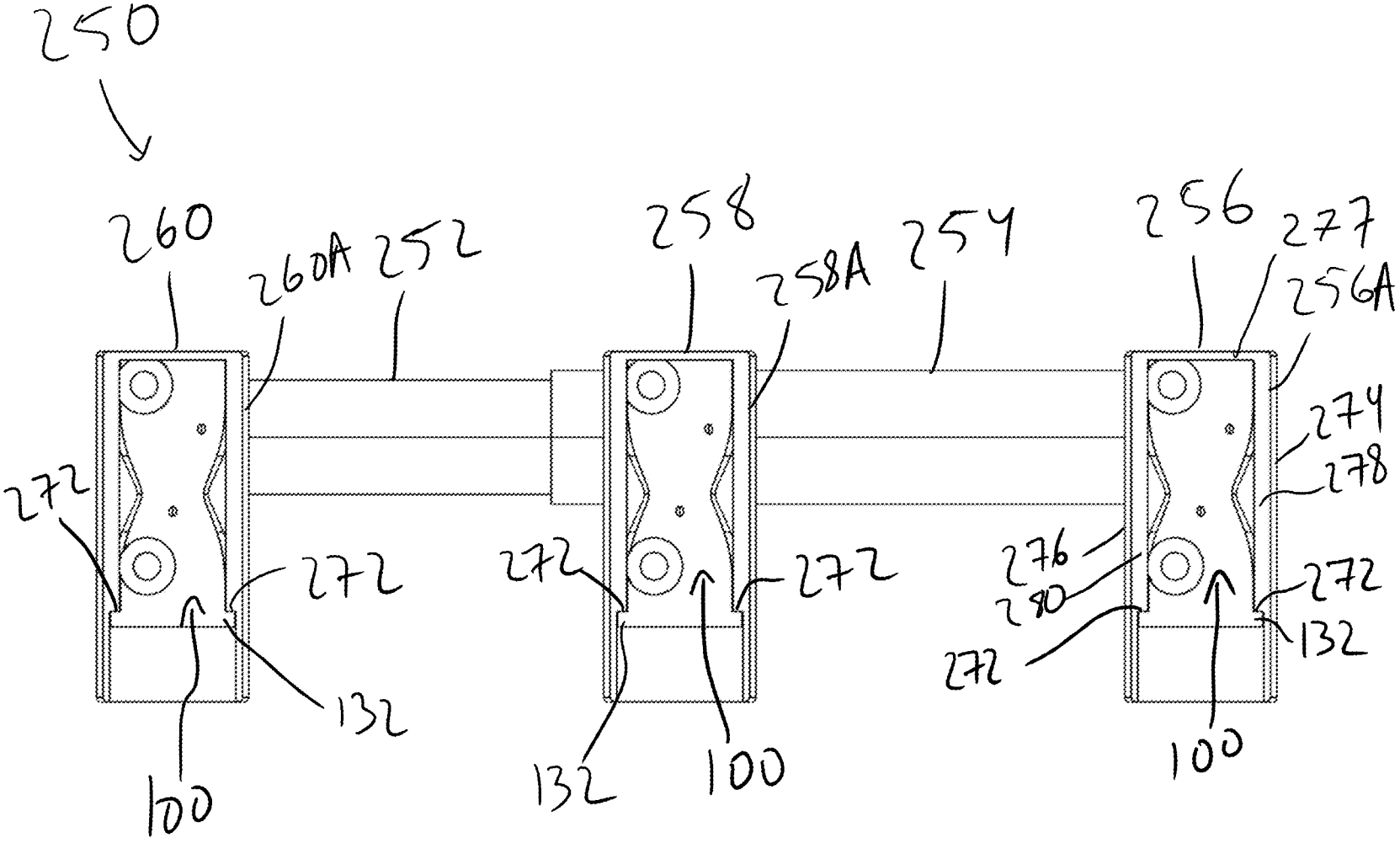
FIG. 13 is a rear elevation view of the rod system of FIG. 11 attached to the mounting brackets.
Figure 14:
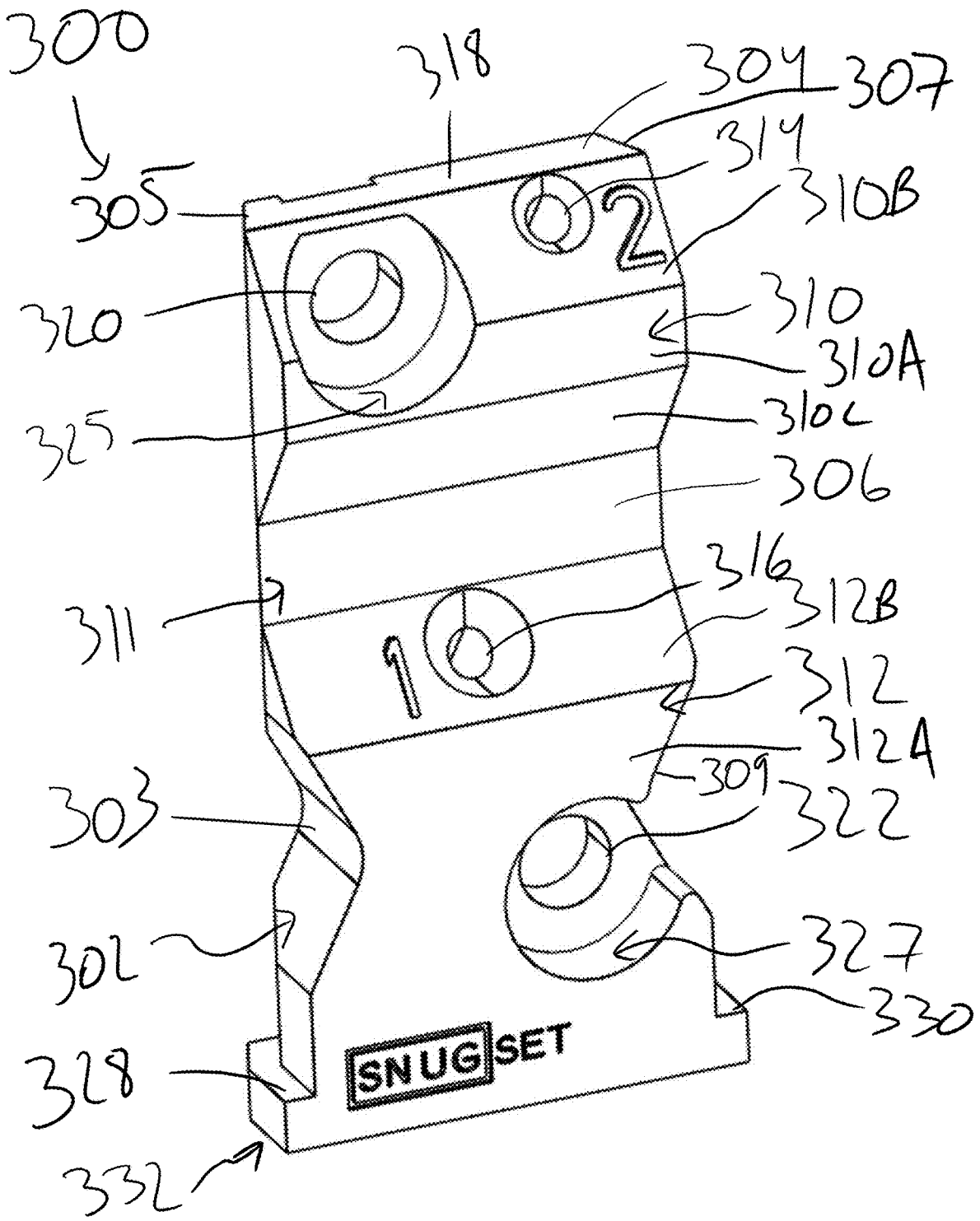
FIG. 14 is a front perspective view of a mounting bracket according to another embodiment.
Figure 15:
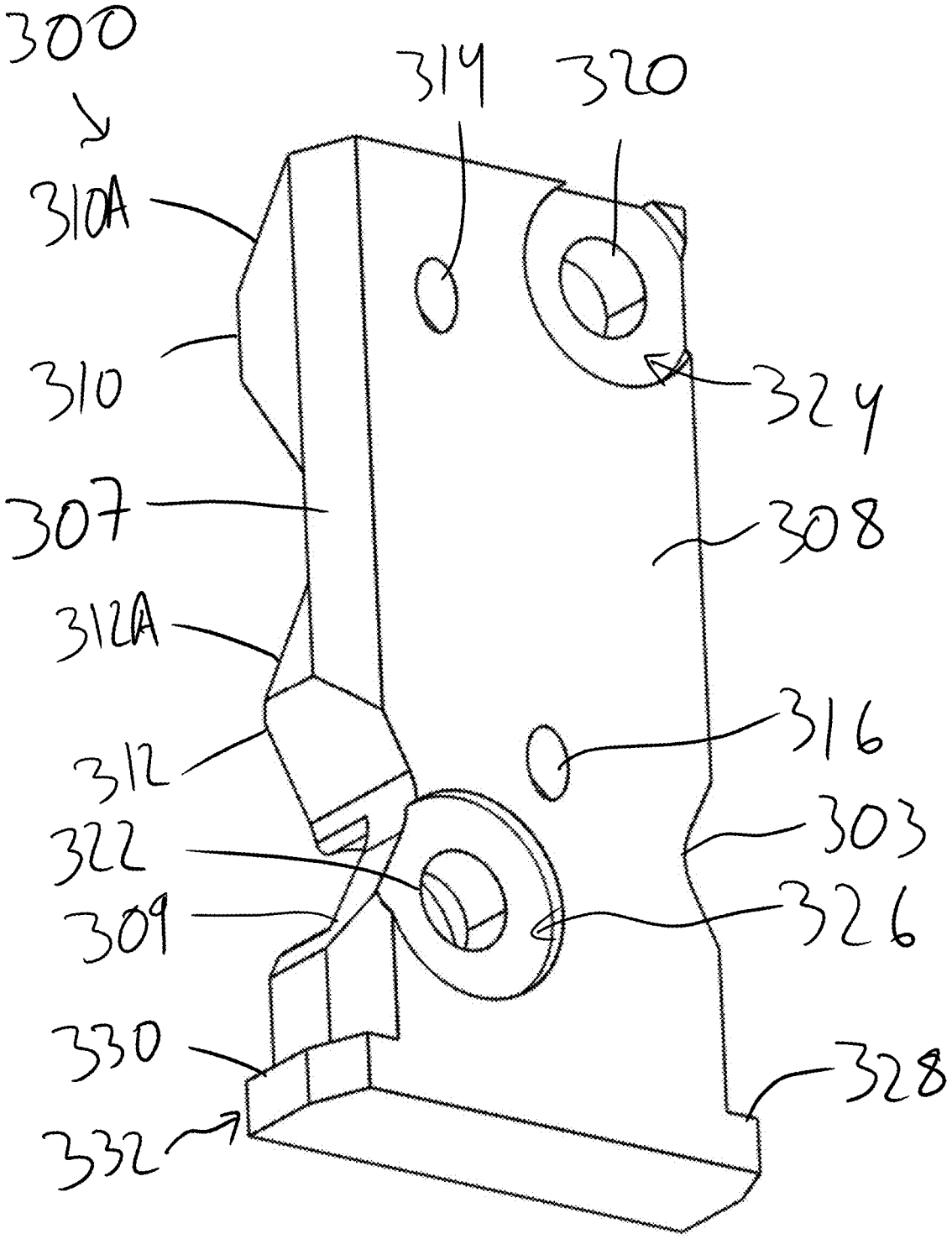
FIG. 15 is a rear perspective view of the mounting bracket of FIG. 14.
Figure 16:
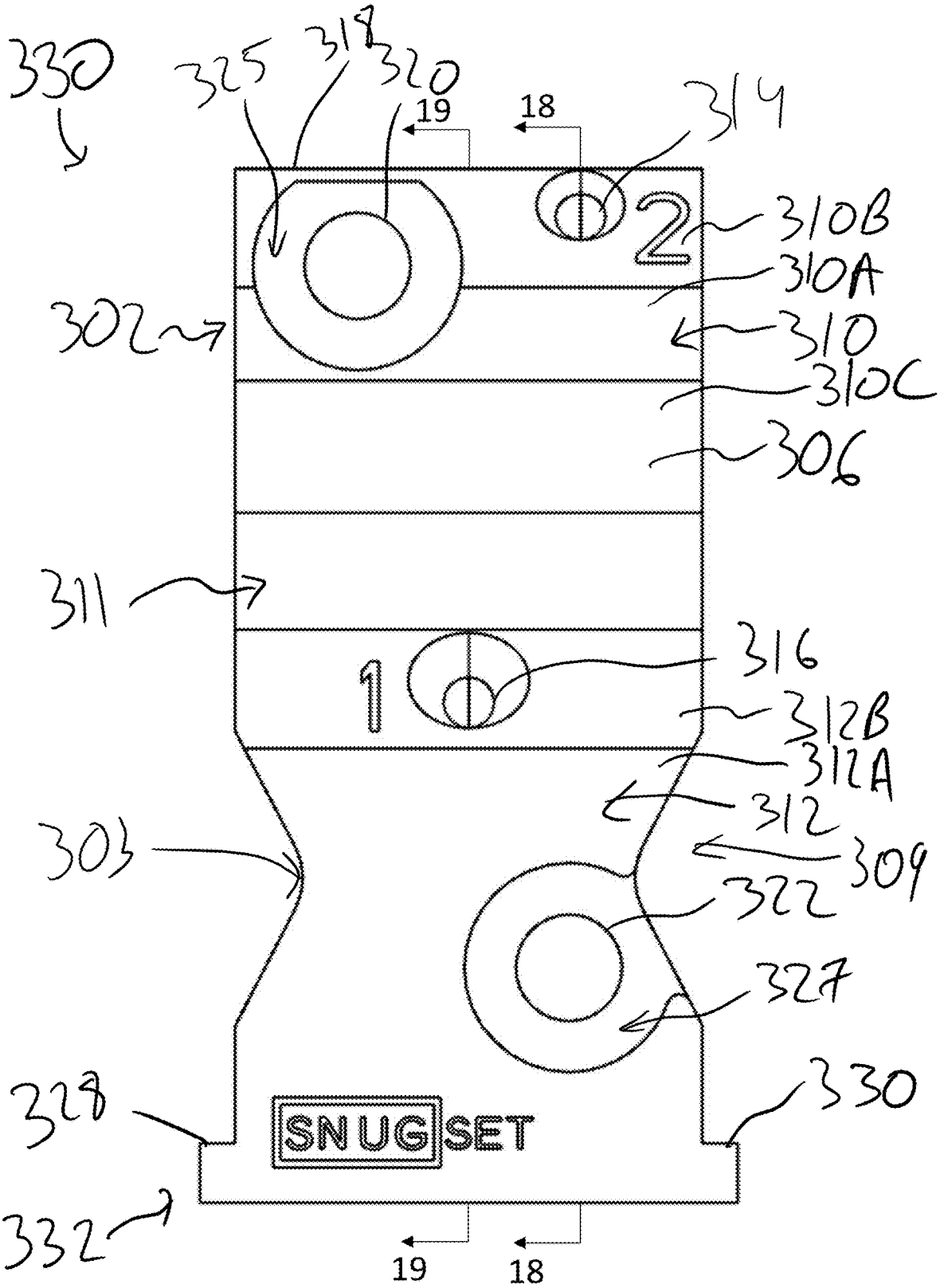
FIG. 16 is a front elevation view of the mounting bracket of FIG. 14.
Figure 17:
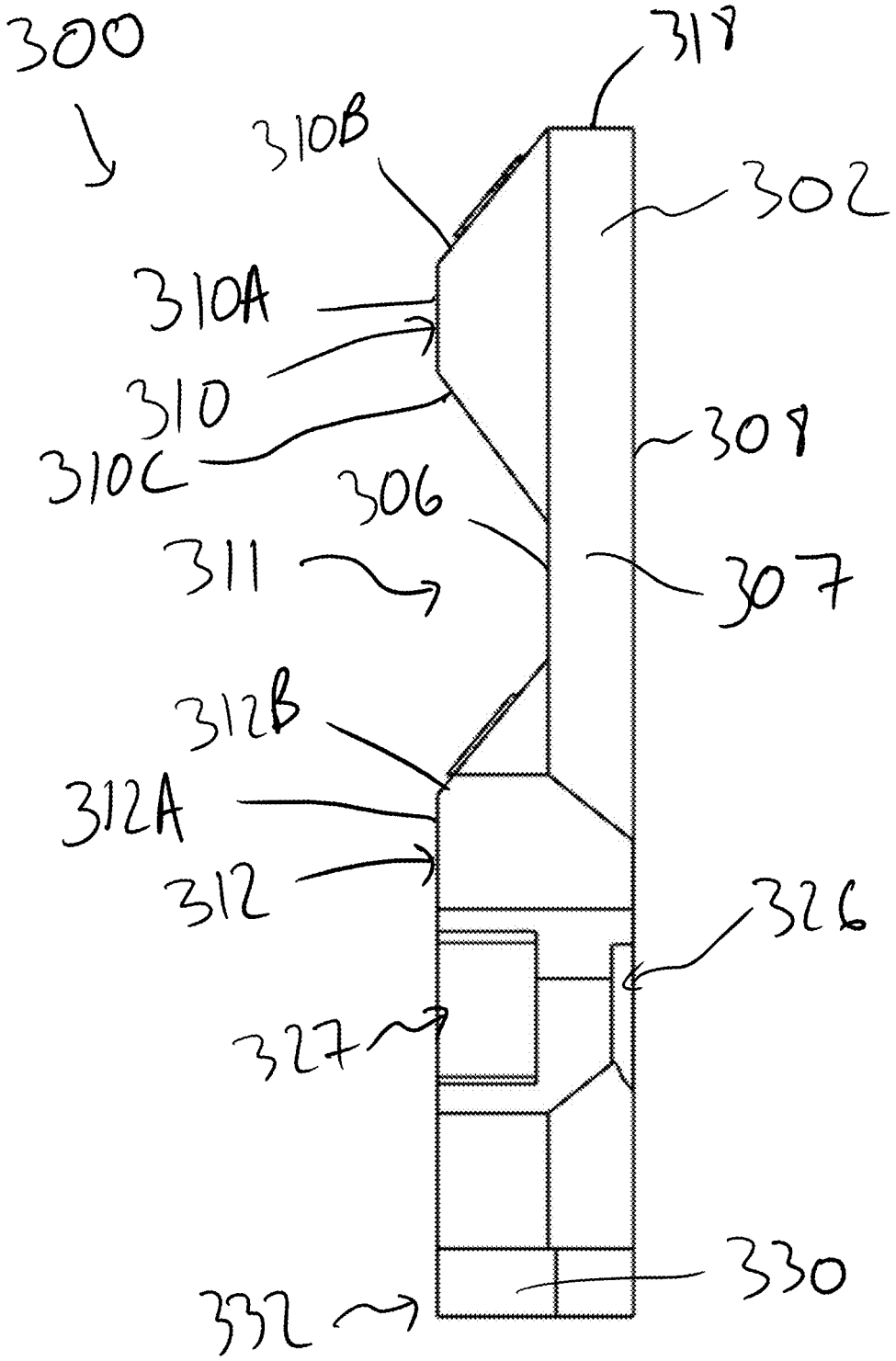
FIG. 17 is a right-side elevation view of the mounting bracket of FIG. 14.
Figure 18:
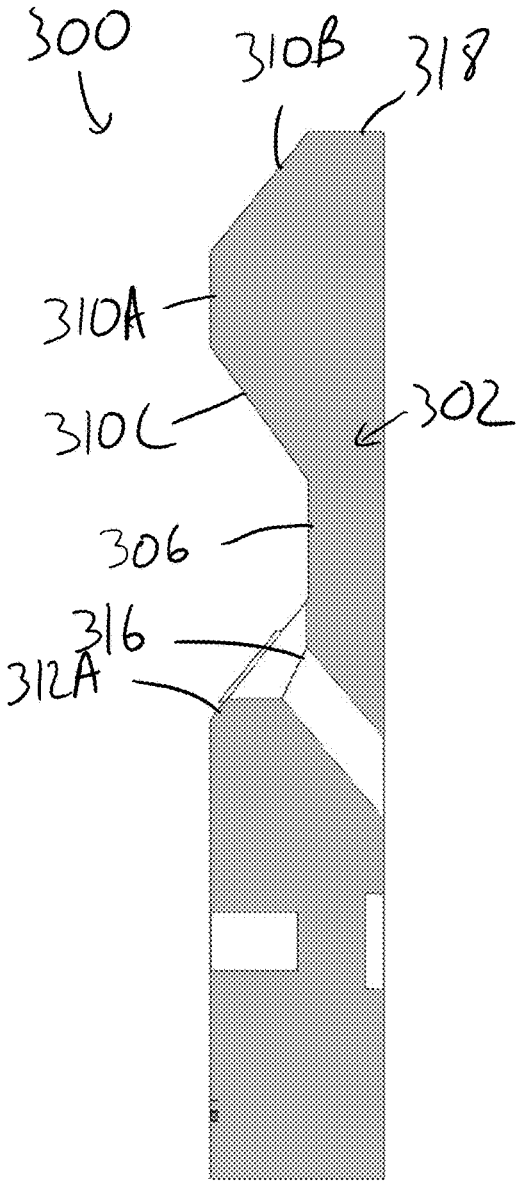
FIG. 18 is a cross-sectional view of the mounting bracket of FIG. 14 taken along line 18-18 of FIG. 16.
Figure 19:
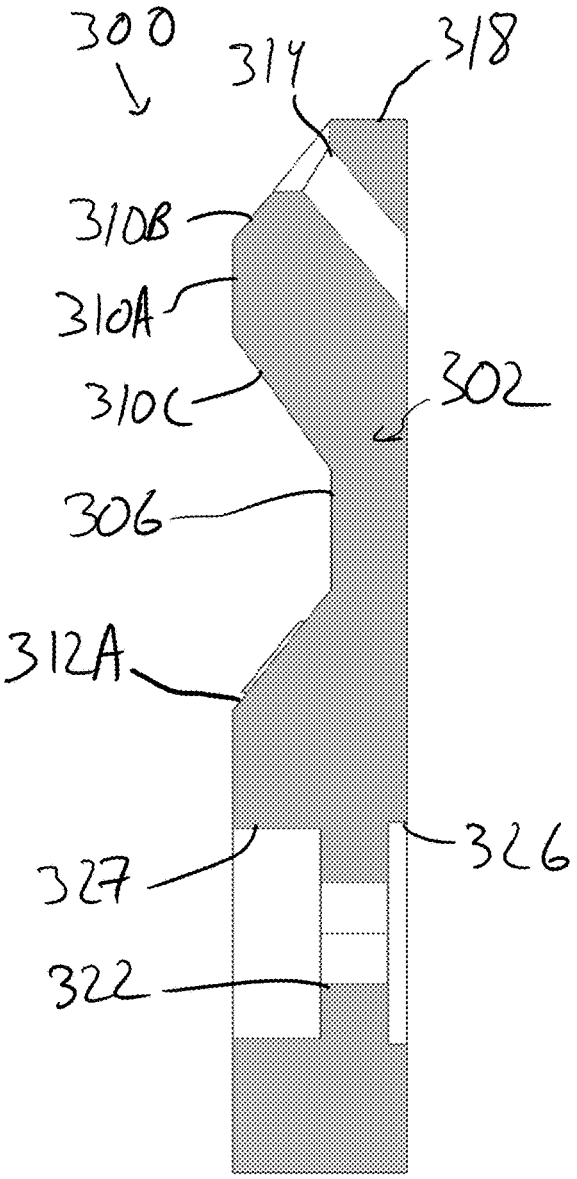
FIG. 19 is a cross-sectional view of the mounting bracket of FIG. 14 taken along line 19-19 of FIG. 16.

With respect to FIGS. 11-13, a rod system 250 is shown that is mounted to a mounting surface by several mounting brackets 100. The rod system 250 includes an inner rod 252, an outer rod 254, a left rod support arm 256, a middle rod support arm 258, and a right rod support arm 260. The inner rod 252 is sized to be telescopically received in the outer rod 254 such that the inner and outer rods 252, 254 together form an adjustable length rod. While the rod system 250 shown includes two rods, the rod system may include three, four, or more rods connected together to form an adjustable length rod. The inner and outer rods 252, 254 may be supported by the left rod support arm 256, the middle rod support arm 258, and the right rod support arm 260. The rod support arms 256, 258, 260 are similar in many respects to the rod support arm 200 discussed above such that the differences will be highlighted in the following discussion. The rod support arms 256, 258, 260 each include an attachment leg 256A, 258A, 260A and arms 256B, 258B, 260B like the rod support arm 200. The attachment legs 256A, 258A, 260A are configured to be slidably attached to a mounting bracket 100 like the rod support arm 200 discussed above.

The base 132 of each mounting bracket 100 is concealed in its respective attachment leg 256A, 258A, 260A of the rod support arms 256, 258, 260. More specifically, the attachment legs 256A, 258A, 260A extend over the base 132 when attached thereto (see FIG. 13). For instance, with respect to the left rod support arm 256, the attachment leg 256A includes sidewalls 274, 276 that extend rearward to inward extending portions 278, 280. The inward extending portions 278, 280 are positioned to contact the base 132 of the mounting bracket 100 when the rod system 250 is mounted to the mounting brackets 100. The ends 272 of the inward portions 278, 280 serve as a stop to limit movement of the rod system 250 in direction 270 as the rod system 250 is mounted to the mounting brackets 100. The inward portions 278, 280 do not extend to the bottom of the attachment leg 256A, which permits the attachment leg 256A to extend below the base 132 of the mounting bracket 100. This permits the mounting bracket 100 to be concealed by the rod support arm 256 when the rod support art 256 is attached to the mounting bracket 100. The attachment leg 256A of the left rod support arm 256 may also include a top wall 277 that contacts the top surface 118 of the mounting bracket 100 when the left rod support arm 256 is mounted to the mounting bracket 100. The left rod support arm 256 may be lowered onto the mounting bracket 100 in direction 270 until the top wall 277 rests on the top surface 118 of the mounting bracket 100. The attachment legs 258A, 260A of the middle and right rod support arms 258, 260 are like that of the left rod support arms 256 such that the discussion of these similar aspects will not be repeated.

The arm 256B of the left rod support arm 256 supports a socket 262 opening to the right side for receiving an end of the outer rod 254. The socket 262 may be cylindrical and sized such that an end portion of the outer rod 254 is able to be inserted into the socket 262. The arm 260B of the right rod support arm 260 supports a socket 264 opening to the left side for receiving an end of the inner rod 252. The socket 264 may be cylindrical and sized such that an end portion of the inner rod 252 is able to be inserted into the socket 264. With the ends of the adjustable rod within the sockets 262, 264 of the left and right rod support arms 256, 260, a curtain or drape may be drawn from the rods and over the left and/or right rod support arms 256, 260 to the mounting surface (e.g., a wall). Drawing the curtain or drape to the wall is advantageous for more fully blocking light from entering a room, for example, by blocking light from entering the room around the sides of a curtain.

The middle rod support arm 258 includes a cylindrical ring 266 through which the outer rod 252 and/or inner rod 252 may extend. For example, the inner diameter of the cylindrical ring 266 may be sized such that the outer rod 254 and inner rod 252 are able to be inserted therethrough to be supported by the cylindrical ring 266. In some forms, the inner diameter of the cylindrical ring 266 is smaller than the outer rod 254 such that the cylindrical ring 266 of the middle rod support arm 258 is sized to receive and support the inner rod 252. The cylindrical ring 266 may include a threaded hole and a screw 268 for securing the inner rod 252 and/or outer rod 254 within the cylindrical ring 266. The screw 268 may be rotated to extend the screw into the cylindrical ring 266 and against the rod 252, 254 extending therethrough to clamp the rod 252, 254 against the cylindrical ring 266 and to inhibit the rod 252, 254 from sliding relative to the cylindrical ring 266. The screw 268 may also be rotated to withdraw the screw 268 from the cylindrical ring 266 to permit the rod 252, 254 to slide through the cylindrical ring 266.

To attach the rod system 250 to the mounting surface, the mounting brackets 100 may be mounted to a mounting surface (e.g., a wall) as described above at locations along the mounting surface for the left, middle, and right rod support arms 256, 256, 260. The elongated slot 216 of the attachment legs of the rod support arms 256, 256, 260 may be aligned with the upper end of the corresponding mounting bracket 100. The rod system 250 may be moved downward in direction 270 to insert the plate portion 104 of the mounting brackets 100 into the elongated slot 216. The rod system 250 may be lowered in direction 270 until ends 272 of the angled end portions 278, 280 of the attachment legs of the rod support arms 256, 256, 260 contact the base 132 of the mounting brackets 100 and/or the top wall 277 of the rod support arms 256, 258, 260 contact the top surface 118 of the mounting bracket 100.

With respect to FIGS. 14-19, a mounting bracket 300 is shown according to another embodiment. The mounting bracket 300 is similar in many respects to the mounting bracket 100 of FIGS. 1-6 such that the differences will be highlighted in the following discussion. The mounting bracket 300 includes a body 302 having a plate portion 304 with a front surface 306 and a rear surface 308. The side edges 305, 307 of the plate portion 304 are tapered from the front surface 306 to the rear surface to form an inner rail to permit hardware (e.g., the rod support arm 200) to be slid over the mounting bracket 300 to attach the hardware to a mounting surface as described above. The side edges 305, 307 may be profiled such that the body 302 has a generally hourglass shape.

The front side of the body 302 of the mounting bracket 300 has an upper portion 310 and a lower portion 312 that span the width of the body 302. The upper portion 310 is spaced apart from the lower portion 312 by a middle portion 311. The upper portion 310 and the lower portion 312 have a support surfaces 310A, 312A, respectively, that contact the hardware mounted thereto to keep the hardware aligned with the body 302 and to absorb load applied to an accessory mounted to the mounting bracket 300. The thickness of the body 310A, 312A may be the thickest portion of the plate portion 304 of the body 302. The middle portion 311 is recessed or inset from upper portion 310 and the lower portion 312 such that the middle portion 311 has a smaller thickness than the body 302 at the support surfaces 310A, 312A of the upper portion 310 and lower portion 312.

The support surfaces 310A, 312A contact the hardware attached to the mounting bracket 300 to aid in keeping the hardware aligned with the mounting bracket 300. For example, when the rod support arm 200 is attached to the mounting bracket 300, an inner surface of the attachment leg 202 of the rod support arm 200 contacts or rests against the support surfaces 310A, 312A which counters the load on the arm 204 and, thus, inhibits the attachment leg 202 from pulling unnecessarily on the upper portion of the mounting bracket 300. The surface area of the support surface 312A of the lower portion 312 may be greater than the surface area of the support surface 310A of the upper portion 310. Providing a lower support surface 312A with an increased surface area absorbs and counters the force applied on the leg 202 by the moment arm load of the arm 204. In other words, a load applied to the arm 204 (e.g., on the cradle 206) forces the lower end portion of the leg 202 against the support surface 312A which, in turn, counters such force applied to the leg 202. This enables the rod support arm 200 to be longer than the mounting bracket 300 without unintentionally detaching the mounting bracket 300 from the support structure, such as a wall.

The upper portion 310 has the support surface 310A with an upper ramped surface 310B and a lower ramped surface face 310C that slope rearwardly as they extend away from the support surface 310A. The upper ramped surface 310B may extend laterally across a substantial portion of the width of the body 302. The upper ramped surface face 310B defines a hole 314 that extends through the body 302 of the mounting bracket 300 to the rear surface 308. The hole 314 includes a countersunk surface that may receive at least a portion of a head of a fastener inserted therethrough.

The lower portion 312 has a ramped surface 312B extending from the middle portion 311 of the body 302 to the support surface 312A of the lower portion 312. The ramped surface 312B defines a hole 316 that extends through the body 302 of the mounting bracket 300 to the rear surface 308. The hole 316 includes a countersunk surface that may receive at least a portion of a head of a fastener inserted therethrough.

The angled faces 310B, 312B may extend obliquely relative to the rear surface 308 of the body 302, for example, at an approximately 45-degree angle relative to the rear surface 308 of the body 102. The holes 314, 316 may extend substantially perpendicularly relative to the angled faces 310B, 312B such that a fastener, such as a nail, may be extended through the hole 314 and downwardly into the mounting surface at an angle in the range of about 30-60 degrees. One angle could be approximately 40-degrees.

The inset middle portion 311 is between the lower ramped surface 310C of the upper portion 310 and the ramped surface 312B of the lower portion 312. The middle portion 311 provides room for a user to insert a fastener into the hole 316 of the lower portion 312 and engage the fastener with a tool to drive (e.g., with a nail and a hammer) the fastener into the mounting surface. For example, the smaller thickness of the middle portion 311 provides clearance to receive a head of a hammer, for instance, when hammering a nail through the hole 316. The middle portion 311 also provides a space for the head of the fastener so that the head of the fastener does not extend outward from the mounting bracket 100, which could interfere with attaching hardware to the mounting bracket 300. The angled upper face 310B also provides space for the head of a fastener such that the head of the fastener does not extend outward from the mounting bracket 100. The hole 314 of the upper portion 310 may extend through an upper portion of the body 302 to provide increased support to hardware mounted on the mounting bracket 300.

The holes 314, 316 may also be laterally offset from one another. For example, the first hole 314 may extend through a right side of the body 302, and the second hole 314 may extend through the center or a left side of the body 302. Having the holes 314, 316 laterally offset from one another allows the fasteners extended therethrough to extend in different vertical planes to avoid obstacles, for example, in a wall. For example, where a fastener extended through hole 314 encounters an obstacle within the wall, a fastener extended through hole 316 may avoid the obstacle being laterally offset from the hole 314. The holes 314, 316 may also be laterally offset from the holes 320, 322 to provide mounting holes at varying locations across the width of the body 302. This provides an installer with flexibility when attaching the mounting bracket 300 to a mounting surface by allowing the installer to select to use any of the mounting holes 314, 316, 320, 322 to avoid obstacles in the mounting surface. The mounting holes 314, 316 may also be vertically offset so that fasteners extended therethrough extend into the mounting surface at different heights which may similarly be used to avoid obstacles in the mounting surface. The mounting holes 320, 322 may also be vertically offset from one another and/or from the holes 314, 316 to similarly increase the probability that at least one hole that avoids an obstacle in the mounting surface.

The lower portion 312 may have a generally hourglass shape having recessed portions 303, 309 formed along the side edges 305, 307. Including the recessed portions 303, 309 may reduce the amount of material used to form the body 312. The recessed portions 303, 309 may also receive a mating structure of the hardware component attached to the body 302 to inhibit the hardware component from moving relative to the body 302. For example, the hardware component may have inwardly extending protrusions that extend into the recessed portions 303, 309 and inhibit the hardware component from sliding vertically along the side edges 305, 307.

By way of example, the body 302 may have a length of approximately 1.75 inches, a width of 1 inch, and a maximum thickness of 0.45 inches. The holes 314, 316 may extend at an approximately 40-degree angle relative to the rear surface 308.

To attach the mounting bracket 300 to a mounting surface, a fastener may be extended through the second hole 316 of the mounting bracket 300 and into the mounting surface. The mounting bracket 300 may be pivoted about the nail extending through the second hole 316 to rotate the mounting bracket 300 to the desired orientation, for example, until a top end 318 of the mounting bracket 300 is level. A fastener may then be extended through the first hole 314 and into the mounting surface to secure the mounting bracket 300 to the mounting surface. Alternatively, the first hole 314 may be used first, and then after orientation about the fastener in the first hole 314, the second hole 316 may be used.

The body 302 of the mounting bracket may further include mounting holes 320, 322 that may also be used for mounting the mounting bracket 300 to a mounting surface. The mounting holes 320, 322 may be used to mount the mounting bracket 300 to a mounting surface as an alternative mounting method or in addition to use of the holes 314, 316 for increased mounting strength. The mounting holes 320, 322 extend from the front surface 306 and through the rear surface 308. Fasteners may be extended through the holes 320, 322 and into the mounting surface to secure mounting bracket 300 to the mounting surface. The rear surface 308 of the body 302 may have recesses 324, 326 formed about the mounting holes 320, 322. The recesses 324, 326 provide space to receive a portion of a wall anchor extending from the wall (e.g., a flange of the wall anchor) such that the rear surface 308 of the body 302 lays flat against the mounting surface.

The front surface 306 of the body 302 may further include recesses 325, 327 formed about the mounting holes 320, 322 to provide space to receive a head of a fastener (e.g., a screw). When the mounting bracket 300 is secured to the wall with fasteners via the holes 320, 322, the head of the fasteners may be received within the recesses 325, 327 so that they do not extend outward beyond the support surfaces 310A, 312A. The lower recess 327 is positioned along the side of the body such that the recess 327 opens to the side of the body 327.

The first mounting hole 320 may be at an upper portion of the body 302, and the second mounting hole 322 may be at a middle or lower portion of the body 302 below the first mounting hole 120. Including at least the first mounting hole 320 at an upper portion of the mounting bracket 300 enables the mounting bracket 300 to provide increased load capacity to support hardware mounted on the mounting bracket 300. The mounting holes 320, 322 may also be laterally offset from one another. For example, the first mounting hole 320 may extend through a left side of the body 302, and the second mounting hole 322 may be extend through a right side of the body 302. Offsetting the holes from one another across the width of the body 302 may aid in avoiding obstacles in the mounting surface as described above.

The body 302 of the mounting bracket 300 includes support flanges 328, 330 that extend outward from the sides of the body 302. The support flanges 328, 330 form a base 332 of the mounting bracket 300 that has a greater width than the plate portion 304 extending upward from the base 332. The support flanges 328, 330 of the base 332 form a stop or support ledge that hardware attached to the mounting bracket 300 contacts to support the hardware attached thereto.

Figure 20:
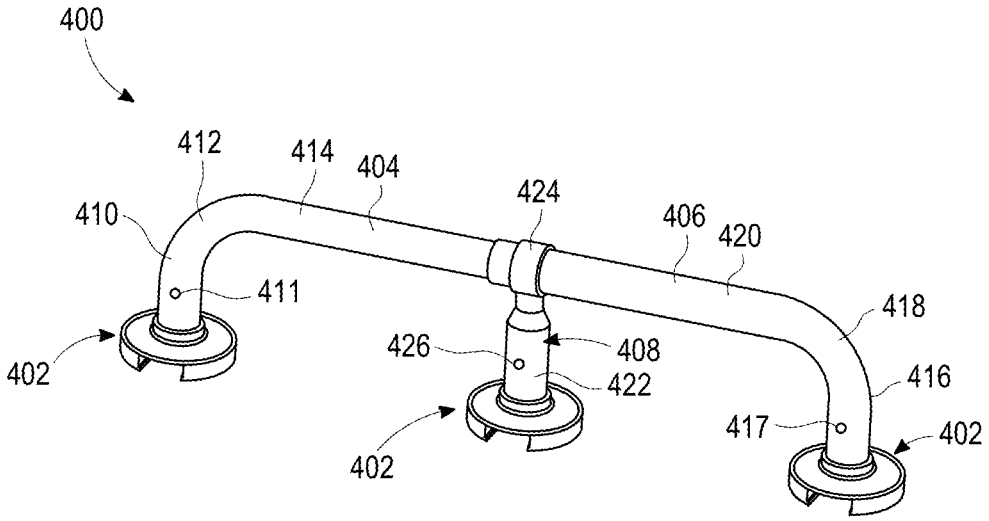
FIG. 20 is a bottom perspective view of a rod system according to another embodiment.
Figure 21:
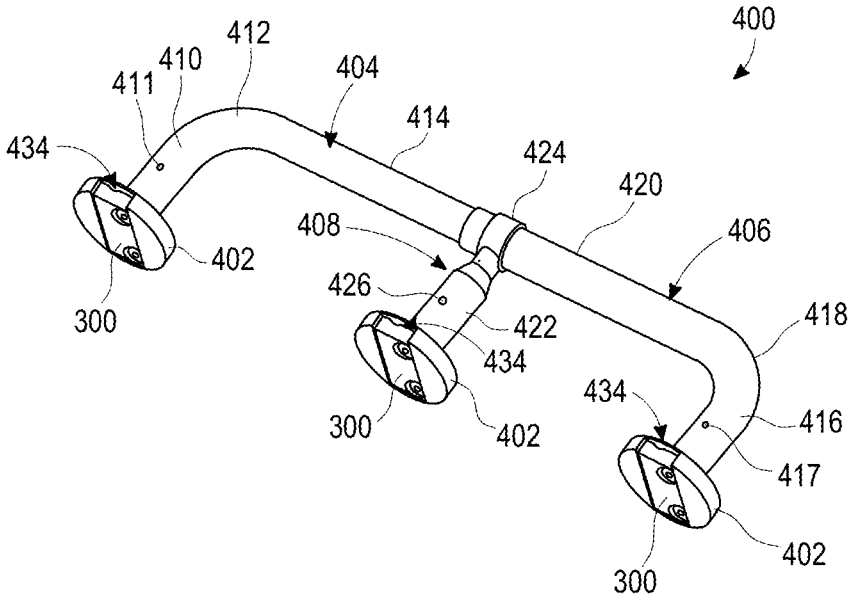
FIG. 21 is a rear perspective view of the rod system of FIG. 20 attached to mounting brackets.

With respect to FIGS. 20 and 21, a rod system 400 is provided according to another embodiment that may be mounted to a mounting surface via mounting brackets such as mounting brackets 100, 300 described above. The rod system 400 includes attachment brackets 402 described in further detail below that may slide onto the mounting brackets 100, 300. The rod system further includes an inner rod 404, an outer rod 406, and a rod support arm 408 that may be connected to the attachment brackets 402. While the rod system 400 shown includes two rods, the rod system may include three, four, or more rods connected together to form an adjustable length rod. The inner rod 404 includes a first straight portion 410 that extends to a curved portion 412 that extends to a second straight portion 414. An end of the first straight portion 410 may be attached to a tube portion 432 of the attachment bracket 402 as described below. The first straight portion 410 may include an attachment hole 411 for attaching the inner rod 404 to the attachment bracket 402.

The outer rod 406 has a first straight portion 416 that extends to a curved portion 418 that extends to a second straight portion 420. An end of the first straight portion 416 of the outer rod 406 may be attached to a tube portion 432 of the attachment bracket 402 as described below (sec FIGS. 22-24). The first straight portion 416 may include an attachment hole 417 for attaching the outer rod 406 to the attachment bracket 402.

With the inner rod 404 and outer rod 406 curving to connect to the attachment bracket 402 of the wall, a curtain or drape suspended by the inner and outer rods 404, 406 may be drawn around the curved portions to the wall to aid in blocking light from entering the room. The rods 404, 406 also may be used as a towel bar or rack. The second straight portion 414 of the inner rod 404 may be telescopingly received in the second straight portion 420 of the outer rod 406 to adjust the overall length of the rod system 400.

The rod support arm 408 includes a tube portion 422 having an end that may be attached to the tube portion 432 of the attachment bracket 402. The tube portion 422 may include an attachment hole 426. The tube portion 422 extends to a rod receiver such as cylindrical ring 424. In some forms, the rod receiver is a cradle such as that shown in the rod support arm 200 of FIG. 7. The ring 424 is like the ring 266 of the middle support arm 258 of FIG. 11 and may be sized to receive and support the second straight portion 420 of the outer rod 406 and/or the second straight portion 410 of the inner rod 404. The rod support arm 408 may provide increased support to the inner and outer rod 404, 406 to support the weight of a curtain, drape, towels, and/or other objects suspended from the rods 404, 406 and to inhibit or reduce the sagging of the rods 404, 406 between the outer attachment brackets 402. While one rod support arm 408 is shown, in other embodiments, two or more rod support arms 408 may be positioned along the length of the inner and outer rods 404, 406 to provide support to the rods 404, 406.

Figure 23:
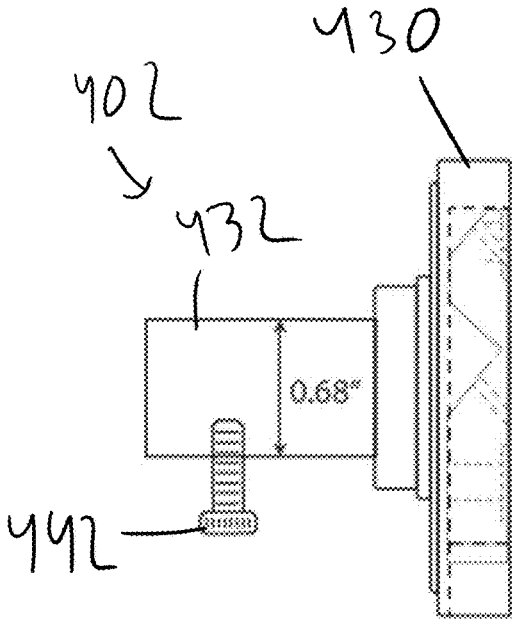
FIG. 23 is a side elevation view of the attachment bracket of FIG. 22.
Figure 22:
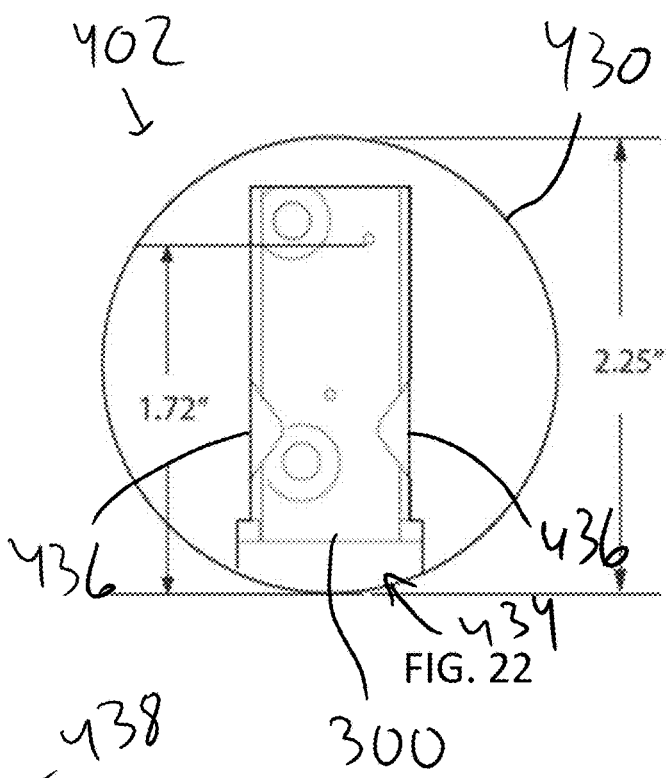
FIG. 22 is a rear elevation view of an attachment bracket of the rod system of FIG. 20.
Figure 24:
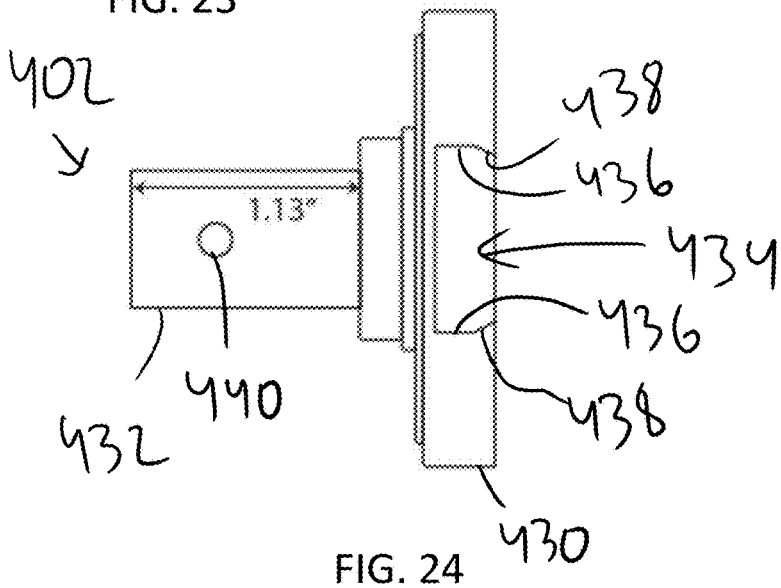
FIG. 24 is a bottom plan view of the attachment bracket of FIG. 22.

With respect to FIGS. 22-24, the attachment bracket 402 includes a base 430 and the tube portion 432 extending from the base 430. In some forms, the base 430 and the tube portion 432 are formed unitarily as a single piece. In some forms, the base 430 and the tube portion 432 are formed separately and attached together, for example, via a fastener, welding, or an adhesive. The base 430 may have a generally cylindrical or disc shape although other shapes and configurations may be used to provide a desired aesthetic or ornamental design to the rod system 400. A rear portion of the base 430 may include a slot 434 for receiving a portion of the mounting brackets 100, 300 that is similar in many respects to the attachment leg 256A of the left rod support arm 265 of FIG. 11. The slot 434 includes sidewalls 436 having end portions 438 that extend inward over the slot 434 and toward one another. The end portions 438 of the sidewalls may extend inward to catch the tapered edges of the plate portion 104 of the mounting bracket 100 similar to the angled end portions 212A, 214A of the sidewalls 212, 214 of the rod support arm 200 of FIG. 6. This prevents the attachment bracket 402 from pulling away from the mounting bracket 100.

The tube portion 432 may include a threaded hole 440 for receiving a fastener such as screw 442. The screw 442 may be used to secure the inner and outer rods 404, 406 and the rod support arm 408 to the attachment bracket 402. For example, with respect to the inner rod 404, an end of the first straight portion 410 may receive the tube portion 432 of the attachment bracket 402. The inner rod 404 may be slid and rotated relative to the tube portion 432 until the attachment hole 411 and the threaded hole 440 of the tube portion 432 are aligned. The screw 442 may be extended through the attachment hole 411 and threaded into the threaded hole 440 of the tube portion 432 to secure the inner rod 404 to the attachment bracket 402. The outer rod 404 and rod support arm 408 may similarly be attached to the attachment bracket 402 using the respective attachment holes 417, 426.

In use, the mounting brackets 100, 300 may be mounted to the mounting surface (as discussed above) at the desired locations for the ends of the rod system 400 and the rod support arm 408. The second straight portion 420 of the outer rod 406 may be extended through the ring 424 of the rod support arm 408. The second straight portion 414 of the inner rod 404 may be inserted into the outer rod 406. The first straight portion 410 of the inner rod 404 may be connected to the tube portion 432 of an attachment bracket 402. The first straight portion 416 of the outer rod 406 may be connected to the tube portion 432 of an attachment bracket 402. The tube portion 422 of the rod support arm 408 may be connected to the tube portion 432 of an attachment bracket 402. The slots 434 of the attachment brackets 402 may be aligned with the corresponding mounting brackets 100, 300 secured to the mounting surface and lowered to receive the mounting bracket 100, 300 into the slots 434 of the attachment brackets 402.

Figure 25:
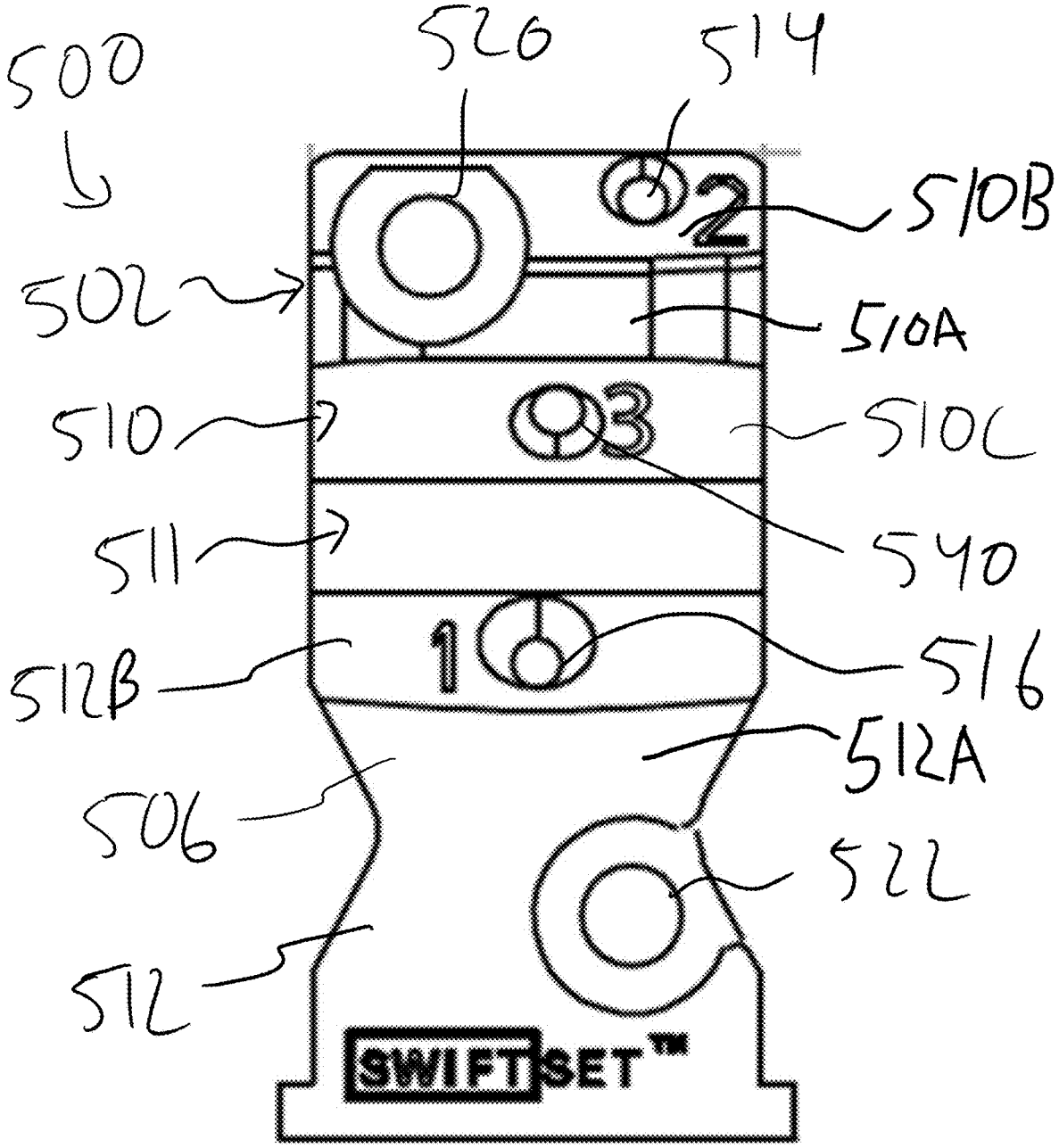
FIG. 25 is a front elevation view of a mounting bracket according to another embodiment.
Figure 26:
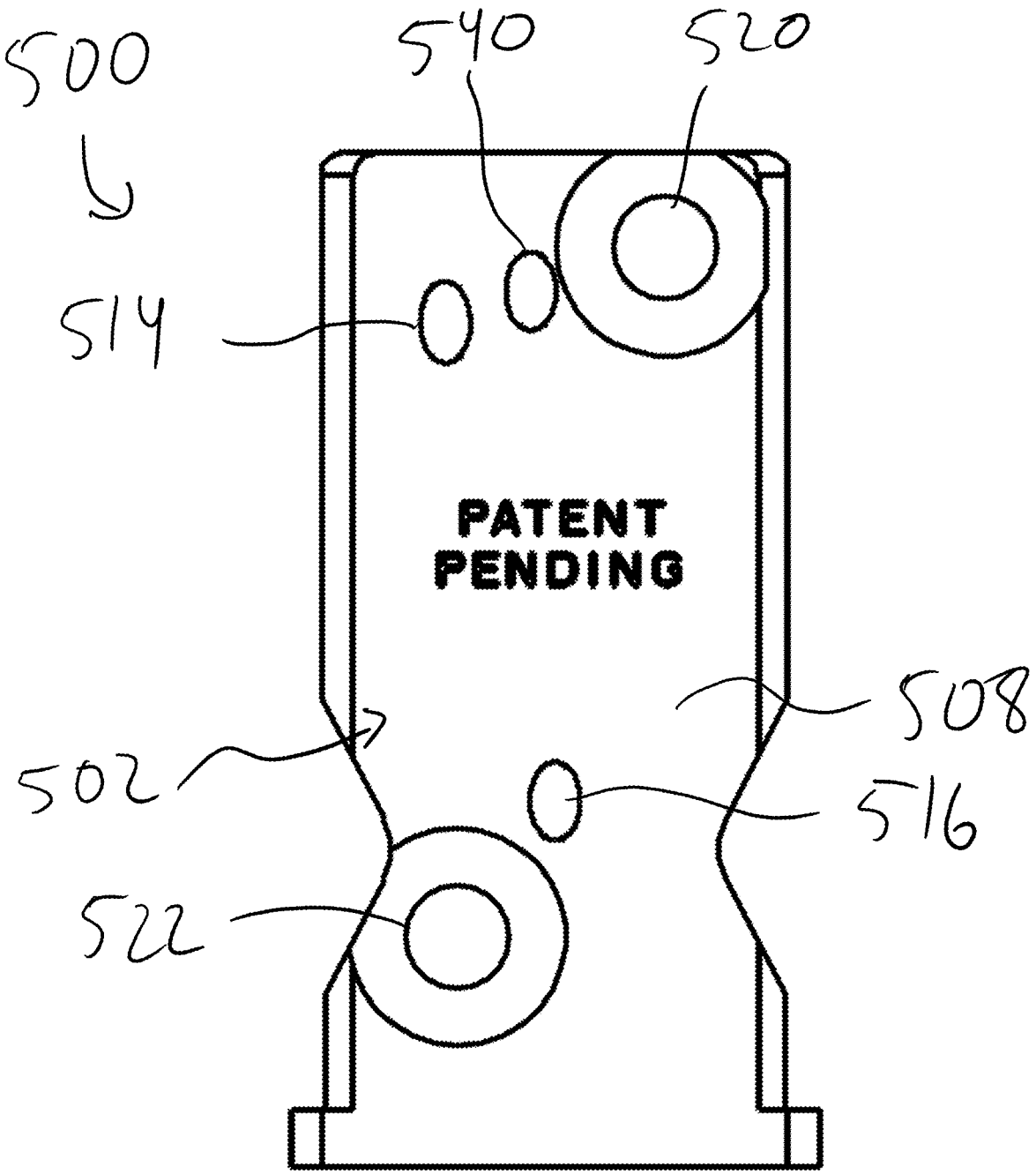
FIG. 26 is a rear elevation view of the mounting bracket of FIG. 25.
Figure 27:
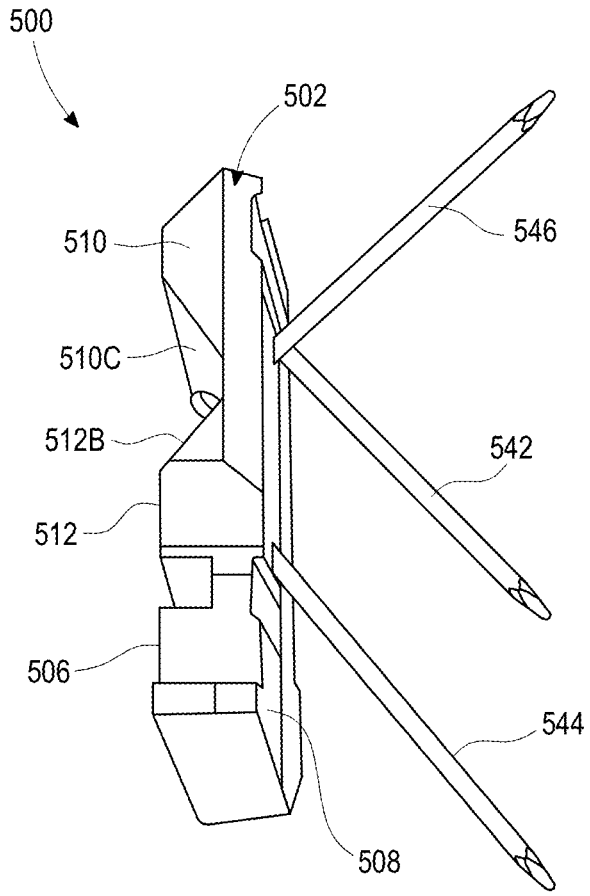
FIG. 27 is a side elevation view of the mounting bracket of FIG. 25 with fasteners extended through openings of the mounting bracket.

With respect to FIGS. 25-27, a mounting bracket 500 is shown according to another embodiment. The mounting bracket 500 is similar in many respects to the mounting bracket 300 of FIGS. 14-19 such that the differences will primarily be highlighted in the following discussion. For conciseness and clarity, the references numeral used for features of the mounting bracket 300 of the embodiment of FIGS. 14-19 that correspond to similar features of the mounting bracket 500 of the embodiment of FIGS. 25-27 will be used with the prefix changed from a "3" to a "5." For example, a feature of the mounting bracket 300 referenced by the reference numeral "310" will be shown with reference numeral "510" with regard to the mounting bracket 500.

In mounting bracket 500, the lower ramped surface 510C of the upper portion 510 of the body 502 defines a hole 540 that extends through the body 502 from the front surface 506 to the rear surface 508. The hole 540 includes a countersunk surface that may receive at least a portion of a head of a fastener 546 inserted therethrough. The lower ramped surface 510C may extend obliquely relative to the rear surface 508 of the body 502, for example, at an approximately 45-degree angle relative to the rear surface 308 of the body 102. The hole 540 may extend substantially perpendicularly relative to the lower ramped surface 510C such that a fastener, such as a nail, may be extended through the hole 540 and upwardly into the mounting surface at an angle in the range of about 30-60 degrees. One angle could be approximately 40-degrees.

Extending the fastener 546 upwardly into the mounting surface aids to inhibit the upper end of the rear surface 508 of the body 502 of the mounting bracket 500 from pulling away or separating from the mounting surface, for example, when a load is applied to the mounting bracket 500. In other words, the upwardly extending fastener 546 inhibits the mounting bracket 500 from pivoting away from the mounting surface about the lower end of the body 502. For example, in one test, mounting the mounting bracket 500 to a wall using the hole 540 in addition to holes 514, 516 was found to increase the amount of weight the mounting bracket 500 can hold by about 90% compared to using only holes 514, 516. In this test, the rod support arm 200 was attached to the mounting bracket 500 and a load applied to the cradle until the mounting bracket 500 failed and began to pull away from the wall. Loads were applied with the mounting bracket 500 secured to the wall using only holes 514, 516 and using holes 514, 516, and 540 to compare the two mounting configurations. A load was hung from the center of the cradle 206 of the rod support arm 200 which is about 2.8125 inches from the mounting bracket 500. The weight of the load was increased until the mounting bracket 500 pulled away from the wall. The mounting bracket 500 was able to hold up to about 10 lbs. when mounted using only holes 514, 516 and was able to hole up to about 19 lbs. when mounting using holes 514, 516, and 540.

The inset middle portion 511 between the lower ramped surface 510C of the upper portion 510 and the ramped surface 512B of the lower portion 512 provides room for a user to insert a fastener into the hole 540 of the upper portion 510 and engage the fastener with a tool to drive (e.g., with a nail and a hammer) the fastener into the mounting surface. For example, the smaller thickness of the middle portion 511 provides clearance to receive a head of a hammer, for instance, when hammering a nail through the hole 540. The middle portion 511 also provides a space for the head of the fastener so that the head of the fastener does not extend outward from the mounting bracket 500, which could interfere with attaching hardware to the mounting bracket 500.

The hole 540 may be used along with hole 514 and/or hole 516 to mount the mounting bracket 500 to the mounting surface. To attach the mounting bracket 500 to a mounting surface, fasteners 542, 544 may be extended through the holes 514, 516 of the mounting bracket 500 and into the mounting surface as discussed with respect to the mounting bracket 300 above. A fastener 546 may then be extended through the hole 540 and into the mounting surface at an angle (e.g., approximately a 90-degree) to the fasteners 542, 544 to secure the mounting bracket 500 to the mounting surface. As shown in FIG. 27, the fasteners 542, 544 extend through holes 514, 516 downwardly from the rear surface 508 while the fastener 546 extends through hole 540 and upwardly from the rear surface 508. Alternatively, the hole 540 may be used first, and then after orientation about the fastener 546 in the hole 540, the holes 514, 516 may be used. Additionally, one or more of holes 514, 516, 540 may be used with hole 520 and/or hole 522 to mount the mounting bracket 500 to the mounting surface.

While the mounting bracket 500 described above includes two downwardly extending holes 514, 516 and one upwardly extending hole 540, the mounting bracket 500 may further include additional mounting holes through which fasteners may be extended to mount the body to a mounting surface (e.g., a wall). For instance, the body 502 may include two, three, or more mounting holes that extend upwardly, for example, similar to hole 540. The upwardly extending mounting holes may extend through the upper portion 510, middle portion 511, and/or lower portion 512 of the body 500. Additionally or alternatively, the body 502 may include three or more holes that angle downwardly through the body, for example, similar to holes 514, 516. The downwardly extending mounting holes may extend through the upper portion 510, middle portion 511, and/or lower portion 512 of the body 502. Additionally or alternatively, the body 502 may include additional mounting holes that extend through the body 502 perpendicular to the rear surface 508 to direct a fastener perpendicular to the wall. Such perpendicular extending mounting holes may extend through the upper portion 510, middle portion 511, and/or lower portion 512 of the body 502 and may, for example, guide a fastener extended therethrough perpendicularly into the mounting surface similar to holes 514, 516, 540. Thus, in some forms, the mounting bracket 500 may have mounting holes that extend upwardly, downwardly, and perpendicularly through the body 502 to direct fasteners upwardly, downwardly, and perpendicularly into the mounting surface to secure the mounting bracket 500 thereto.

Figure 28:
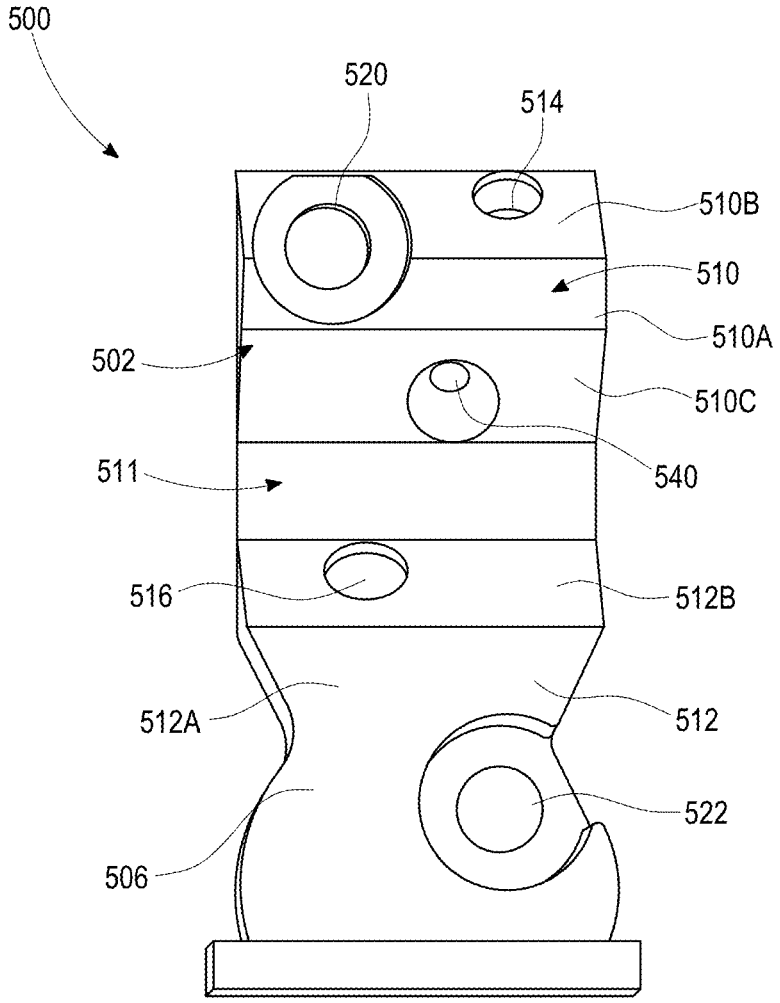
FIG. 28 is a front view of the mounting bracket of FIG. 25 having an alternative hole configuration.

With respect to FIG. 28, the mounting bracket 500 is shown with the hole 516 shifted laterally from the center of the mounting bracket 500. Shifting the hole 516 may provide additional clearance for inserting the fasteners 544, 546 into holes 516 and 540. For example, shifting the hole 516 further out of alignment with hole 540 provides an installer with more clearance for a tool (e.g., a hammer) for inserting the fastener 546 into hole 540 once fastener 544 has been extended into hole 516. Moreover, shifting hole 516 may make it easier to mold the body 502 as the portion of the mold forming holes 516, 540 are able to be withdrawn from the holes 516, 540 without interference.

In other embodiments, the other mounting holes of the mounting bracket 500 may also be shifted laterally across the body 502 of the mounting bracket 500. For example, the position of the hole 514 and hole 520 may be swapped. In another example, hole 514 is positioned at the center of the mounting bracket 500. In other embodiments, the positions of one or more of the ramped surfaces 510B, 510C, 512A may be shifted upward or downward along the length of the body 500, for example, to adjust the position of the mounting holes 514, 516, 540 and thus the position through which a fastener extends from the body 502 into the mounting surface.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, those skilled in the art will recognize that a wide variety of modifications, alterations, and combinations can be made with respect to the above-described embodiments without departing from the scope of the invention, and that such modifications, alterations, and combinations are to be viewed as being within the ambit of the inventive concept.

What is claimed is:

1. A mounting bracket for attachment to a mounting surface comprising:

a body having a first surface and an opposite second surface, the first surface including a first support surface profiled to engage an accessory mounted to the body, and the second surface profiled to engage a mounting surface, the first support surface being overlapped at least in part with a portion of the second surface to engage the mounting surface to transfer force applied to the first support surface to the mounting surface, the body defining first mounting holes extending from the first surface to the second surface, each first mounting hole of the first mounting holes extending obliquely relative to the second surface to guide a fastener extended therethrough into the mounting surface at an angle, the body defining second mounting holes extending through the body, the first surface, and the second surface, each second mounting hole of the second mounting holes extending substantially perpendicularly relative to the second surface; and a ratio of the first mounting holes to the second mounting holes being at least 2:2, wherein the body includes a first end portion including a first end of the body and a second end portion including a second end of the body, wherein the first end portion of the body defines a first mounting hole of the first mounting holes which extends toward the first end of the body and a second mounting hole of the first mounting holes which extends toward the second end of the body opposite the first end to guide fasteners therethrough to inhibit shifting of the first end portion of the body from the mounting surface when force is applied to the first support surface at the second end portion of the body.

2. The mounting bracket of claim 1 wherein the second end of the body is a bottom end and the first end of the body is a top end.

3. The mounting bracket of claim 1 wherein the body includes a ramped surface extending from the first support surface such that a thickness of the body at the first support surface is greater than at the ramped surface, the first mounting hole of the first mounting holes extending through the ramped surface.

4. The mounting bracket of claim 1 wherein the body includes opposing side edges, the side edges include at least a tapered portion on which the accessory slides to mount the accessory to the body.

5. The mounting bracket of claim 1 wherein a ratio of first mounting holes extending toward the second end of the body to first mounting holes extending toward the first end of the body is at least 2:1.

6. The mounting bracket of claim 1 wherein the first mounting holes have an asymmetric pattern relative to a central longitudinal axis and/or a central transverse axis of the body.

7. The mounting bracket of claim 1 wherein the second mounting holes have an asymmetric pattern relative to a central longitudinal axis and/or a central transverse axis of the body.

8. A mounting bracket for attachment to a mounting surface comprising:

a body having a first surface and an opposite second surface, the first surface including a first support surface profiled to engage an accessory mounted to the body, and the second surface profiled to engage a mounting surface, the first support surface being overlapped at least in part with a portion of the second surface to engage the mounting surface to transfer force applied to the first support surface to the mounting surface, the body defining first mounting holes extending from the first surface to the second surface, each first mounting hole of the first mounting holes extending obliquely relative to the second surface to guide a fastener extended therethrough into the mounting surface at an angle, the body defining second mounting holes extending through the body, the first surface, and the second surface, each second mounting hole of the second mounting holes extending substantially perpendicularly relative to the second surface; and a ratio of the first mounting holes to the second mounting holes being at least 2:2, wherein at least one of the first mounting holes extends toward a first end of the body and at least one of the first mounting holes extends toward a second end of the body opposite the first end;

wherein the first surface of the body includes a second support surface profiled to engage the accessory, the body including a recessed portion between the first support surface and second support surface, at least one mounting hole of the first mounting holes extending through the body at the recessed portion.

9. The mounting bracket of claim 8 wherein the body includes a ramped surface extending from the second support surface such that a thickness of the body at the second support surface is greater than at the ramped surface, a first mounting hole of the first mounting holes extending through the ramped surface.

10. A mounting bracket comprising:

a single piece body having a first surface and an opposite second surface, the first surface including a first support surface profiled to enable an accessory to engage and slide along the first support surface when mounting the accessory to the body;

the single piece body including a stop surface to limit movement of the accessory along the body as the accessory is slid along the body from a first end portion of the body toward a second end portion of the body to mount the accessory to the body, the stop surface being at the second end portion; and the single piece body defining at least one mounting hole including a first mounting hole extending obliquely through the body relative to the second surface, the first mounting hole extending in part toward the first end portion of the body as the first mounting hole extends from the first surface toward the second surface, wherein the first surface further includes a second support surface profiled to engage an accessory mounted to the body, a first surface area of the first support surface being less than a second surface area of the second support surface.

11. The mounting bracket of claim 10 wherein the second end portion of the body includes a projection including the stop surface.

12. The mounting bracket of claim 10 wherein the first surface of the body includes a recessed portion that is recessed relative to the first support surface, the first mounting hole disposed in the recessed portion such that a head of a fastener extended through the first mounting hole is recessed relative to the first support surface.

13. The mounting bracket of claim 10 wherein the at least one mounting hole is a plurality of mounting holes including the first mounting hole and a second mounting hole, wherein the second mounting hole extends in part toward the second end portion of the body as the second mounting hole extends from the first surface toward the second surface.

14. The mounting bracket of claim 13 wherein the first mounting hole is substantially perpendicular to the second mounting hole.

15. The mounting bracket of claim 10 wherein the body includes opposing side edges, the side edges include at least a tapered portion on which the accessory slides when mounting on the body.

16. The mounting bracket of claim 10 wherein the body includes a chamfer about the first mounting hole.

17. The mounting bracket of claim 10 wherein the body further includes a set of mounting holes extending through the body from the first surface to the second surface substantially perpendicular to the second surface.

* * * * *